US006393624B1

(12) United States Patent
Iwashita

(10) Patent No.: US 6,393,624 B1
(45) Date of Patent: May 28, 2002

(54) DAMPING DEVICE FOR A TOILET SEAT AND LID UNIT IN WESTERN-STYLE TOILET

(75) Inventor: Hiroyuki Iwashita, Nagano (JP)

(73) Assignee: Sankyo Seiki Mfg. Co., Ltd., Nagano (JP)

( * ) Notice: Subject to any disclaimer, the term of this patent is extended or adjusted under 35 U.S.C. 154(b) by 0 days.

(21) Appl. No.: 09/401,677

(22) Filed: Sep. 22, 1999

(30) Foreign Application Priority Data

Nov. 5, 1998 (JP) ..... 10-330183
Aug. 19, 1999 (JP) ..... 11-232082

(51) Int. Cl.[7] ..... A47K 13/04
(52) U.S. Cl. ..... 4/248; 16/54
(58) Field of Search ..... 4/236, 241, 248, 4/240, 246.1, 246.2; 188/306, 307, 290; 16/54, 55, 68, 255, 277, 319, 58, DIG. 9; 418/154

(56) References Cited

U.S. PATENT DOCUMENTS 1,970,008 A * 8/1934 Larson ..... 16/58
5,255,396 A * 10/1993 Miyahara et al. ..... 4/248
5,664,286 A * 9/1997 Sorimachi ..... 4/246.2
5,697,122 A * 12/1997 Okabe et al. ..... 188/307
5,720,370 A * 2/1998 Takahashi ..... 188/306
5,724,683 A * 3/1998 Sorimachi et al. ..... 4/248

FOREIGN PATENT DOCUMENTS

DE 3722114 A1 * 1/1988

* cited by examiner

*Primary Examiner*—Robert M. Fetsuga
*Assistant Examiner*—Tuhn Nguyen
(74) *Attorney, Agent, or Firm*—Hogan & Hartson, L.L.P.

(57) ABSTRACT

A damping device for damping the relative rotation of a rotating member. The damping device includes a casing, a rotor disposed in an interior space of the casing, and a damping mechanism including a viscous liquid disposed in an annular chamber formed between the casing and the rotor. The viscous liquid exerts frictional forces to damp the relative rotation between the rotor and the casing in a first rotation direction but not in the opposite rotation direction, the damping force increasing when the rotor and the casing rotate relative to each other from a first relative angular position to a second relative angular position in the first rotation direction. The casing and the rotor are structure to provide a damping force by impeding the flow of the viscous liquid within the chamber, and to provide another damping force by the contacting of the rotor and the casing. A valve is further provided within the chamber to restrict the flow of the viscous liquid. A toilet seat and lid unit incorporating two identically shaped damping devices, as well as a toilet bowl incorporating the seat and lid unit are also provided.

8 Claims, 24 Drawing Sheets

DAMPING DEVICE FOR A TOILET SEAT AND LID UNIT IN WESTERN-STYLE TOILET

BACKGROUND OF THE INVENTION

1. Field of the Invention

This invention relates to a damping device for toilet seat or toilet lid in a western-style toilet, and a toilet equipped with the damping device.

2. Description of the Related Art

In some high-quality western-style toilets, in order to prevent an impact sound from occurring when the toilet seat or lid is dropped, damping devices (or slow-closing devices) have been provided on the axis of rotation of the toilet seat or toilet lid in order to mitigate the force of rotational motion. For example, in the toilet seat and toilet lid opening/closing device disclosed in Japanese Unexamined (Kokai) Patent Application No. Hei 4[1992]-259424, as shown in FIG. 26, hinges 202 and 203 for the toilet seat 201 and hinges 205 and 206 for the toilet lid 204 are placed side-by-side, and opening and closing devices 207 and 208 that have damping functions are provided outside these hinges.

With this opening and closing device, a driving force transfer hole 210 such as a square hole is formed in one of the hinges 202 of the toilet seat 201, and a driving force non-transfer hole (not shown in the figure) that does not transfer drive force is formed in the other hinge 203. In addition, a driving force non-transfer hole (not shown in the figure) is formed in one of the hinges 205 for the toilet seat cover 204, and a drive force transfer hole 212 is formed in the other hinge 206. Thus, one of the hinge pins 215 links the hinge 202 of the toilet seat 201 and one of the opening-closing devices 207, and the other hinge pin 216 links the hinge 206 of the toilet lid 204 and the other opening/closing device 208. As a result, the rotation of the toilet seat 201 in the downward direction is damped by one of the opening/closing devices 207, and rotation of the toilet lid 204 in the downward direction is damped by the other opening-closing device 208.

Another opening/closing device for toilet seats or toilet lids is disclosed in Japanese Kokai Patent Application No. Hei 8[1996]-117148, shown in FIG. 27. An attachment member 222 is fastened to the toilet 221, and opening/closing devices 223, 224 having symmetrical orientations are inserted into the attachment member 222. Hinges 225 that constitute the attachment parts for the toilet seat are then disposed on both sides of the attachment member 222, and hinges 226 that constitute the attachment parts for the toilet lid are disposed on both sides of hinges 225. An attachment pin 227 is attached on the side of the opening/closing device 223, and an attachment pin 228 is attached on the side of the opening/closing device 224, while passing through the hinges 225 and 226.

On the other hand, with common western-style toilets, a variety of integrated toilet seat and lid units having different shapes or colors are available, and may be interchangeably installed on toilets. In the United States in particular, these types of toilet seat/toilet lid units are sold at low cost, and users may obtain toilet seat/toilet lid units that match their personal preferences. It is common for users themselves to dispose of old units, and use screws to attach the newly purchased unit. This attachment is carried out by providing an attachment member having a retention part that retains the rotating shaft and fastening flange between the hinge part of the toilet lid and hinge part of the toilet seat, so that attachment may be carried out by fastening this attachment member to the toilet. With toilets on which this type of toilet seat/toilet lid unit is installed, there is no damping mechanism on the side of the toilet to which it is attached, and a loud impact noise is produced when the toilet seat or toilet lid is released when closing the toilet seat, etc. Moreover, damage due to the impact of dropping ensues whereby the hinge parts are broken or the toilet seat or toilet lid is broken.

The opening/closing devices 207, 208 in the opening/closing device for toilet seats and toilet lids disclosed in Japanese Unexamined (Kokai) Patent Application No. Hei 4[1992]-259424 (FIG. 26) have a format whereby they are attached to the side surface of the toilet. This format generally involves attachment to the base cover of a warm water bidet-type toilet seat disposed on both sides of the toilet. For this reason, it is difficult to attach the opening/closing devices 207, 208 with toilets that do not have warm water bidet-type toilet seats. Moreover, the hinge 202 of the toilet seat 201 and the hinge 205 of the toilet lid 204 are in close contact, and the hinge 203 of the toilet seat 201 and the hinge 206 of the toilet lid 204 are in close contact, so there is the danger that the toilet lid 204 will also tend to move downward due to frictional forces when the toilet seat 201 is moved downward.

Moreover, the opening/closing devices 207, 208 are disposed with mirror symmetry, so they are not identical in terms of their damping directions. Specifically, the directions of action of the damping functions must be opposite, so the devices must be structurally different. For this reason, the cost of the opening/closing devices 207 and 208 increases. Moreover, it is necessary not to mistake the left and right parts when attaching them, and assembly errors may easily occur.

Moreover, with the opening/closing device for toilet seats and toilet lids of the toilet disclosed in Japanese Kokai Patent Application No. Hei 8[1996]-117148 (FIG. 27), the opening/closing devices 223, 224 must have a large attachment member 222, so the space for sitting on the toilet 221 is decreased. Moreover, the hinges 225 and 226 are in contact on one side, and the hinges 225 and 226 are also in contact on the other side, so that the same problem occurs as in Japanese Kokai Patent Application No. Hei 4[1992]-259424 described above. Moreover, the opening/closing devices 223, 224 are disposed with mirror symmetry, so the damping direction is not the same for the left and right sides, as with the opening/closing devices 207, 208. For this reason, the same problems arise in this regard as in Japanese Kokai Patent Application No. Hei 4[1992]-259424 described above.

Thus, with conventional opening/closing devices, a spring member is provided on the rotating shaft, which strongly applies a damping force in the final range when a toilet seat or toilet lid undergoes rotational falling, but the structure is complicated, large, costly and difficult to assemble. Moreover, fine response to changes in operating torque of the rotating member is problematic, and it is thus difficult to produce a high-quality feel during use. On the other hand, replaceable toilet seat/toilet lid units, while may be readily removed and attached according to personal preference, have no damping function.

SUMMARY OF THE INVENTION

Accordingly, the present invention is directed to a damping device for toilet seat and lid unit that substantially obviates one or more of the problems due to limitations and disadvantages of the related art.

An object of the present invention is to provide a damping device for a toilet seat/toilet lid unit in a western-style toilet that is easy to install and has a simple structure and low cost.

Another object of the present invention is to provide a damping device for a toilet seat/toilet lid unit in which parts with the same shape and same structure may be attached as-is at the left and right attachment points using two damping devices.

Yet another object of the present invention is to provide a damping device for a toilet seat/toilet lid unit in which control of the rotational force of the seat and/or lid is gradually increased with the rotation of the toilet seat and/or lid.

Additional features and advantages of the invention will be set forth in the description which follows and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, the present invention provides a damping device including a casing, a rotor disposed in an interior space of the casing to form an annular chamber between the casing and the rotor, and a damping mechanism including a viscous liquid disposed in the chamber, the viscous liquid exerting frictional forces to damp the relative rotation between the rotor and the casing in a first rotation direction, the damping force increasing when the rotor and the casing rotate relative to each other from a first relative angular position to a second relative angular position in the first rotation direction. The damping mechanism does not damp the relative rotation of the rotor and the casing in the direction opposite the first rotation direction.

In particular, the casing has at least one protrusion protruding inwardly from the interior surface to the interior space. The rotor has a core with a radius that varies angularly such that the core and the protrusion of the casing forms a gap when the rotor and the casing are at the first relative angular position, and the core and the protrusion come into contact when the rotor and casing rotate relatively from the first relative angular position to or near the second relative angular position, whereby the contact generates a damping force that impedes the relative rotation of the rotor and the casing in the first rotation direction. Further, the protrusion of the casing extends in an axial direction and divides the annular chamber into at least two parts. The viscous liquid flows between the parts of the chamber through the gap between the protrusion and the core of the rotor when the rotor and the casing rotate relatively, and the protrusion impedes the flow of the viscous liquid to generate a damping force that impedes the relative rotation of the rotor and the casing. The interior space defined by the casing may have a radius that decreases with an angular position within an angular range.

In addition, the damping device includes at least one movable valve disposed within the annular chamber between the casing and the core of the rotor and controlling the flow of the viscous liquid within the chamber, the valve being latched to a retaining part of a protrusion of the rotor and moves with the rotor, a latching position of the movable valve changing with the direction of rotation of the rotor. The casing further has an end portion substantially perpendicular to a rotation axis of the rotor and the casing, where a depression is provided on an inner surface of end portion, the depression having a cross-sectional area in the radial direction that varies with an angular position defined on the casing.

According to another aspect of the present invention, a toilet seat and toilet lid unit is provided which incorporates the damping device, where the rotation of the toilet seat and/or lid is damped by the damping device. The toilet seat and toilet lid each have two hinges, and one damping device is disposed between one seat hinge and one lid hinge, and another damping device is disposed between the other seat hinge and the other lid hinge. The two damping devices have the same external appearance.

According to yet another aspect of the present invention, a western-style toilet bowl is provided having toilet seat and toilet lid unit which incorporates the damping device.

It is to be understood that both the foregoing general description and the following detailed description are exemplary and explanatory and are intended to provide further explanation of the invention as claimed.

BRIEF DESCRIPTION OF THE DRAWINGS

FIG. 9(A) is a plan view and FIG. 9(B) is a side view from the direction of the arrow B in FIG. 9(A).

FIG. 11(A) shows the condition when the toilet seat and lid are closed, and FIG. 11(B) shows the condition when the toilet seat and lid are being opened, and FIG. 11(C) shows a completely opened condition.

FIG. 12(A) shows the condition when the toilet seat and lid are open, FIG. 12(B) shows the condition when the toilet seat and lid are being closed, and FIG. 12(C) shows a completely closed condition.

FIG. 13(A) shows the torque curve for the non-circular shape of the inner circumferential surface of the casing, FIG. 13(B) shows the torque curve due to the non-circular shape of the rotor core, and FIG. 13(C) shows the torque curve due to the cavity in the cover end surface.

FIG. 16(A) is a plan view of an inside surface of the cover.

FIG. 21(A) is a first alternative embodiment in which the cut-out recess is not provided, FIG. 21(B) is a second alternative embodiment, and C is a third alternative embodiment.

FIG. 22(A) is a plan view, FIG. 22(B) is a front view from the direction of the arrow B in FIG. 22(A), FIG. 22(C) is a cross-sectional view along the C—C cross section in FIG. 22(A), and FIG. 22(D) is a side view along the direction of the arrow D in FIG. 22(A).

FIG. 23(A) is a plan view.

FIG. 24(A) is a plan view, FIG. 24(B) is a side view along the direction of the arrow B in FIG. 24(A), and FIG. 24(C) is a side view along the direction of the arrow C in FIG. 24(A).

FIG. 25(A) shows the shape of the insertion holes and openings.

DETAILED DESCRIPTION OF THE PREFERRED EMBODIMENTS

Figure 1:
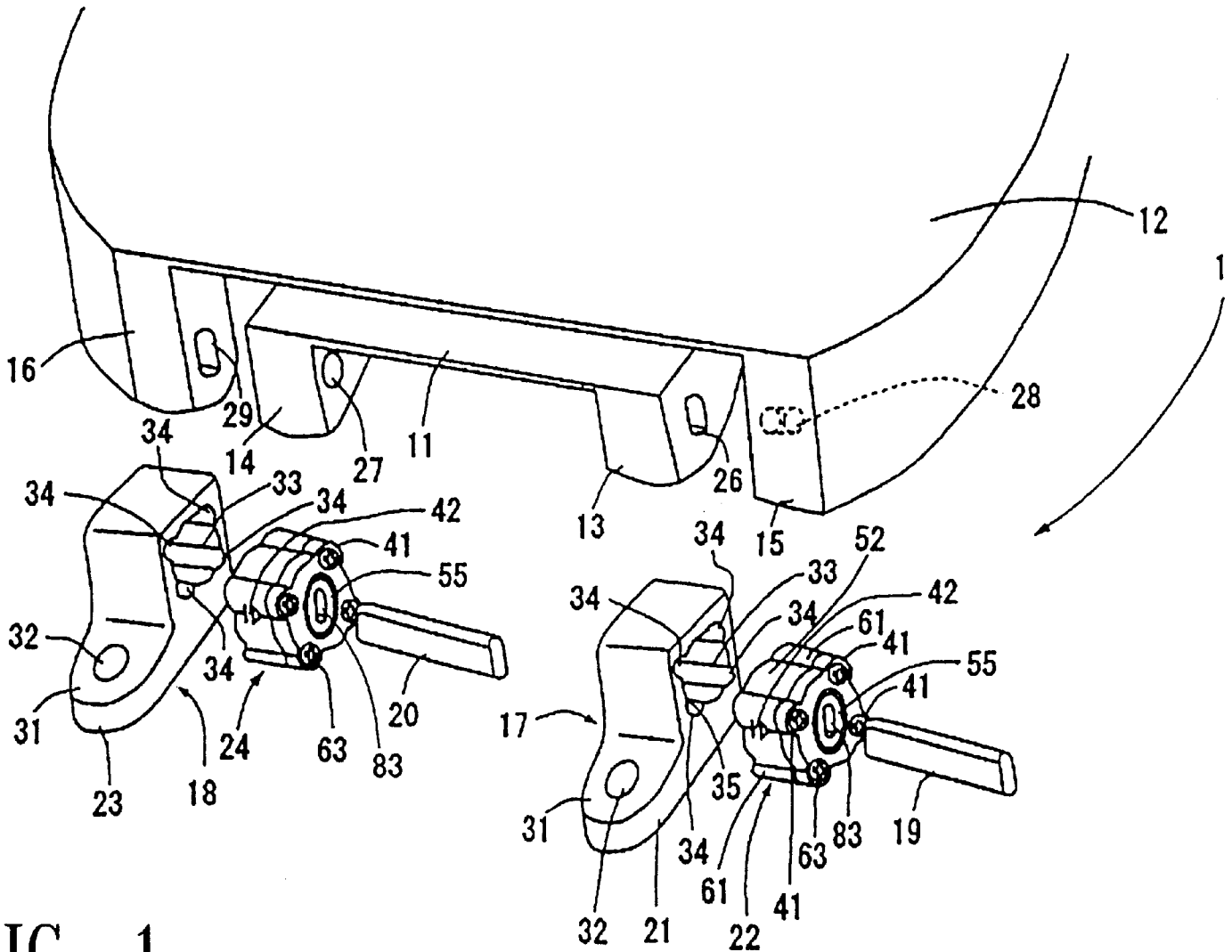
FIG. 1 is an exploded perspective view of the toilet seat/toilet lid unit including the damping device according to an embodiment of the present invention.

Embodiments of the present invention are described below with reference to FIGS. 1–25. As shown in FIG. 1, a western-style toilet includes a toilet body (not shown) and a toilet seat/toilet lid unit 1 attached to the toilet body. The toilet may also includes a tank (not shown) that holds the rinse water.

Figure 2:
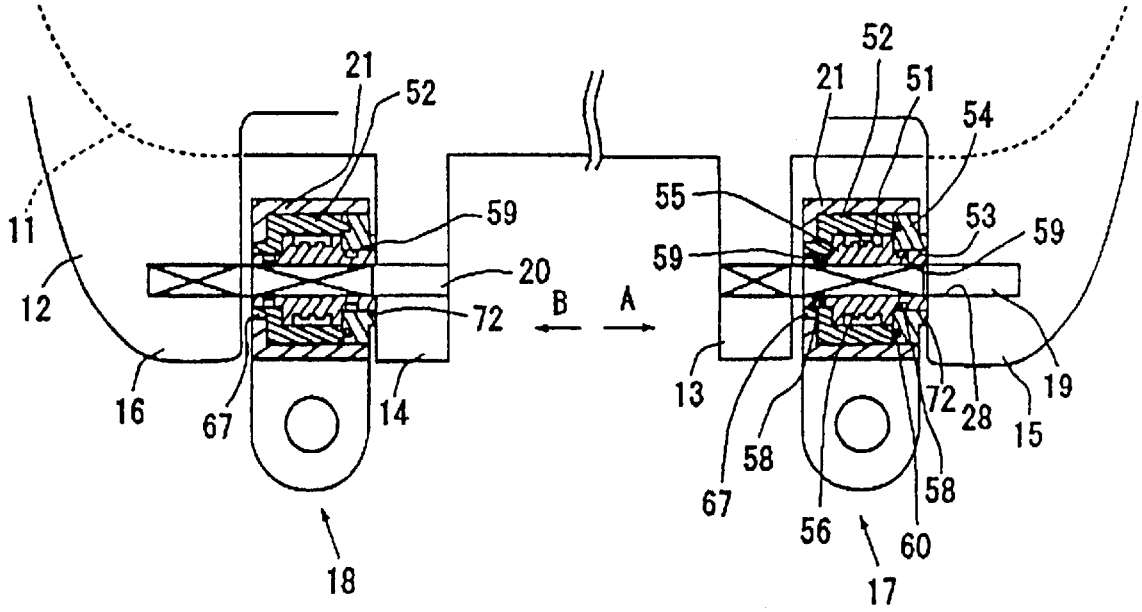
FIG. 2 is a partial cross-sectional plan view showing the structure of the periphery of the hinge for the toilet seat/toilet lid unit of FIG. 1.

Referring to FIGS. 1 and 2, the toilet seat/toilet lid unit 1 includes a toilet seat 11, a toilet lid 12, two toilet seat hinges 13, 14 that serve as attachment hinges, two toilet lid hinges 15, 16 that serve as attachment hinges disposed outside the respective toilet seat hinges 13, 14, a first damper 17 that is provided between one of the toilet seat hinges 13 and one of the toilet lid hinges 15, a second damper 18 that is provided between the other of the toilet seat hinges 14 and the other of the toilet lid hinges 16, a first support shaft 19 that is linked with the first damper 17, and a second support shaft 20 that is linked with the second damper 18. The first damper 17 includes a first attachment casing 21 and a first damping device 22, and the second damper 18 includes a second attachment casing 23 and a second damping device 24. The toilet lid 12 is disposed so that it lays on top of the toilet seat 11 when closed.

As shown in FIG. 1, the toilet seat hinges 13 is formed from a resin member so that it is integrated with the toilet seat 11, and protrudes slightly from the body of the toilet seat 11 on the side of the tank. A hole 26 having an elongated cross-sectional shape is provided on the toilet seat hinge 13 so that it may be linked while being able to rotate as a unit with the support shaft 19. The other toilet seat hinge 14 also is formed from a resin member integrated with the toilet seat 11, and is formed so that its over-all shape is the same as that of the toilet seat hinge 13. The toilet seat hinge 14 has a hole 27 with a circular cross-sectional shape so that it may be linked while allowing the support shaft 20 to rotate.

The toilet lid hinges 15 is formed from a resin member integrated with the toilet lid 12, and is formed so that it is opposite the toilet seat hinge 13. The toilet lid hinge 15 has a hole 28 with a circular cross section so that it may be linked while allowing the support shaft 19 to rotate. The other toilet lid hinge 16 is also formed from a resin member integrated with the toilet lid 12, and is formed with the same shape as the toilet lid hinge 15. A hole 29 having an elongated cross-sectional shape is formed in the toilet lid hinge 16 so that it may be linked while being able to rotate as a unit with the support shaft 20. The cross-sectional shapes of the support shafts 19 and 20 are the same as the cross-sectional shapes of the holes 26 and 29.

The second damper 18 and the first damper 17 are formed from the same material, have the same external shapes and the same structure. Thus, a description will be presented for the structure of the first damper 17 only. The same numerals are used for the second damper 18 in the figures.

The first attachment casing 21 of the first damper 17 has a fastening flange 31 for attachment to the toilet body, an attachment hole 32 provided in the fastening flange 31, an insertion hole 33 in which a first damping device 22 is inserted ("damping device 22" is used for describing the structures for both of the damping devices 22 and 24 below), four cavities 34 in which the four screw fastening parts 41 of the damping device 22 are fit, and a flat alignment part 35 through which one alignment protrusion 42 of the damping device 22 may pass.

In addition to the positioning protrusion 42 and the four screw fastening parts 41, the damping device 22, as shown in FIGS. 1–5, also includes a casing 52 composed of resin having a hole 51 at its center, a cover or end portion 54 composed of resin that fits on the casing 52 and has a hole 53 in its center, a rotor 55 composed of resin that fits in the holes 51 and 53 and is sandwiched by the casing 52 and the cover 54, and a silicone viscous oil 56 that fills the spaces enclosed by the casing 52, the cover 54 and the rotor 55. The casing member is constituted by the casing 52 and the cover 54.

Figure 3:
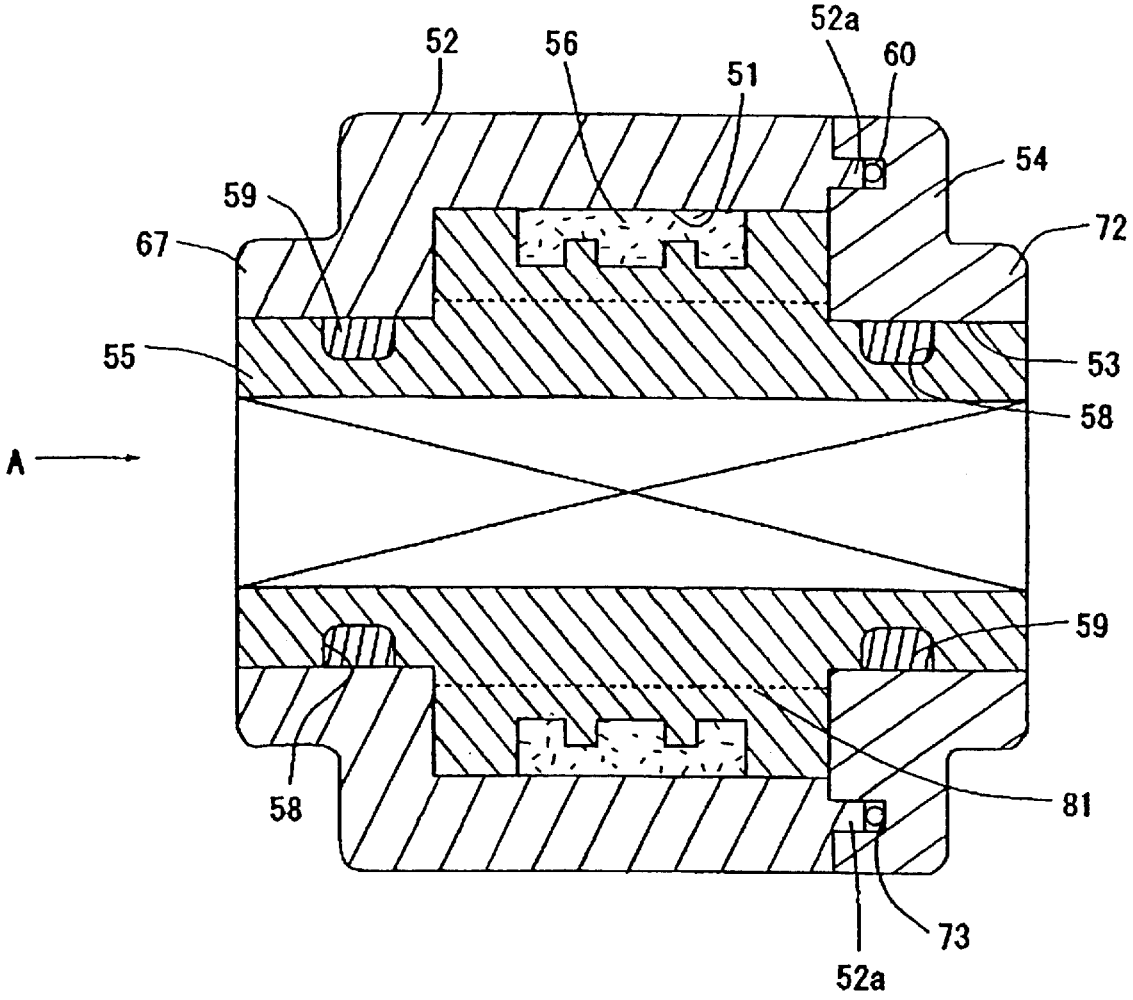
FIG. 3 is an axial cross-section of the damping device used in the toilet seat/toilet lid unit of FIG. 1, showing a state in which the movable valve has been removed.
Figure 4:
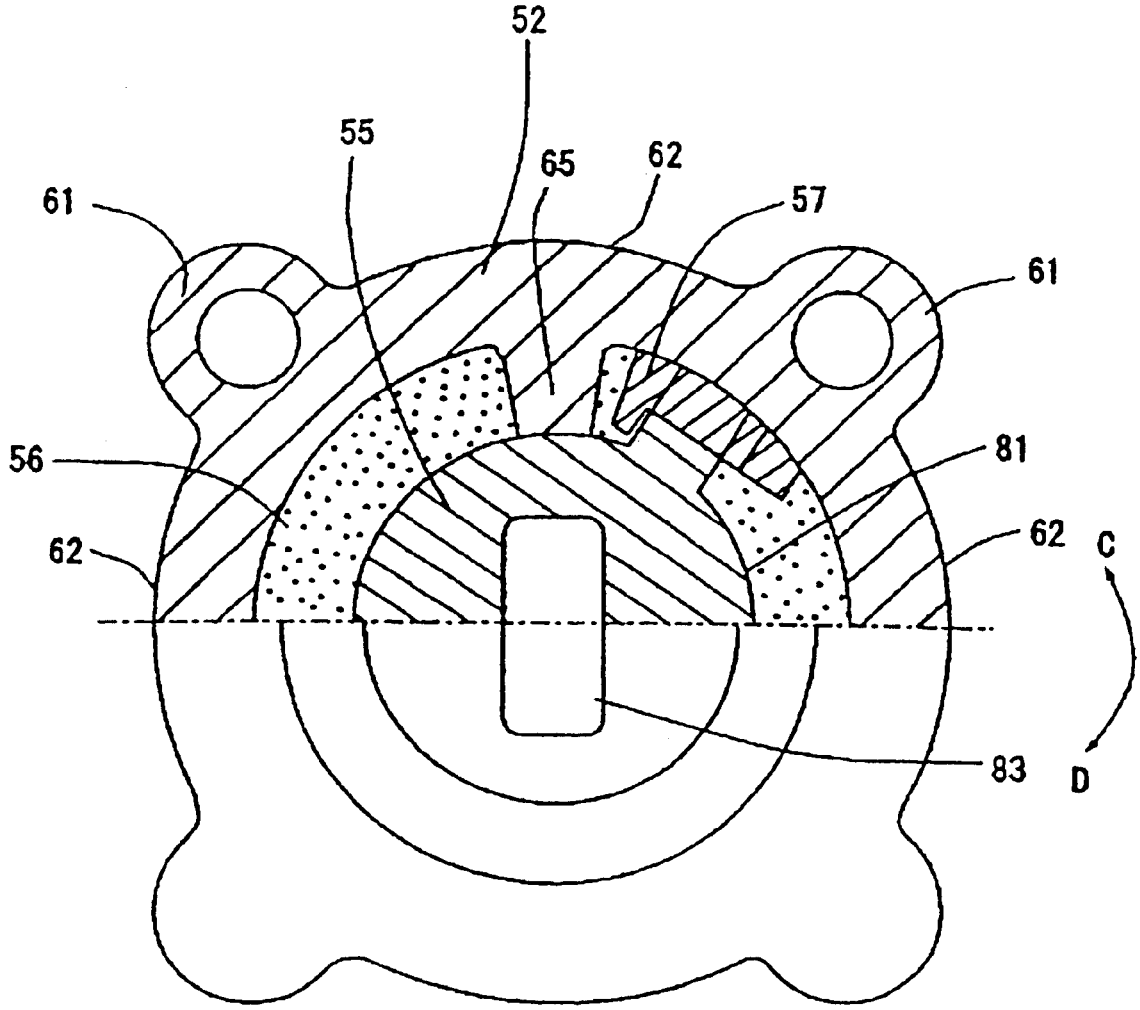
FIG. 4 is a partial cross-sectional side view from the direction of the arrow A in FIG. 3.

The damping device 22, as shown in FIG. 4, has two movable valves 57 composed of resin that control movement of the viscous oil 56 an also constitute part of the rotor 55, O-rings 59 composed of rubber material for sealing the viscous oil 56 which is inserted into grooves 58 provided in the rotor 55 as shown in FIG. 3, and an O-ring 60 composed of rubber material for sealing the liquid viscous oil 56, which is sandwiched by the casing 52 and cover 54.

Figure 5:
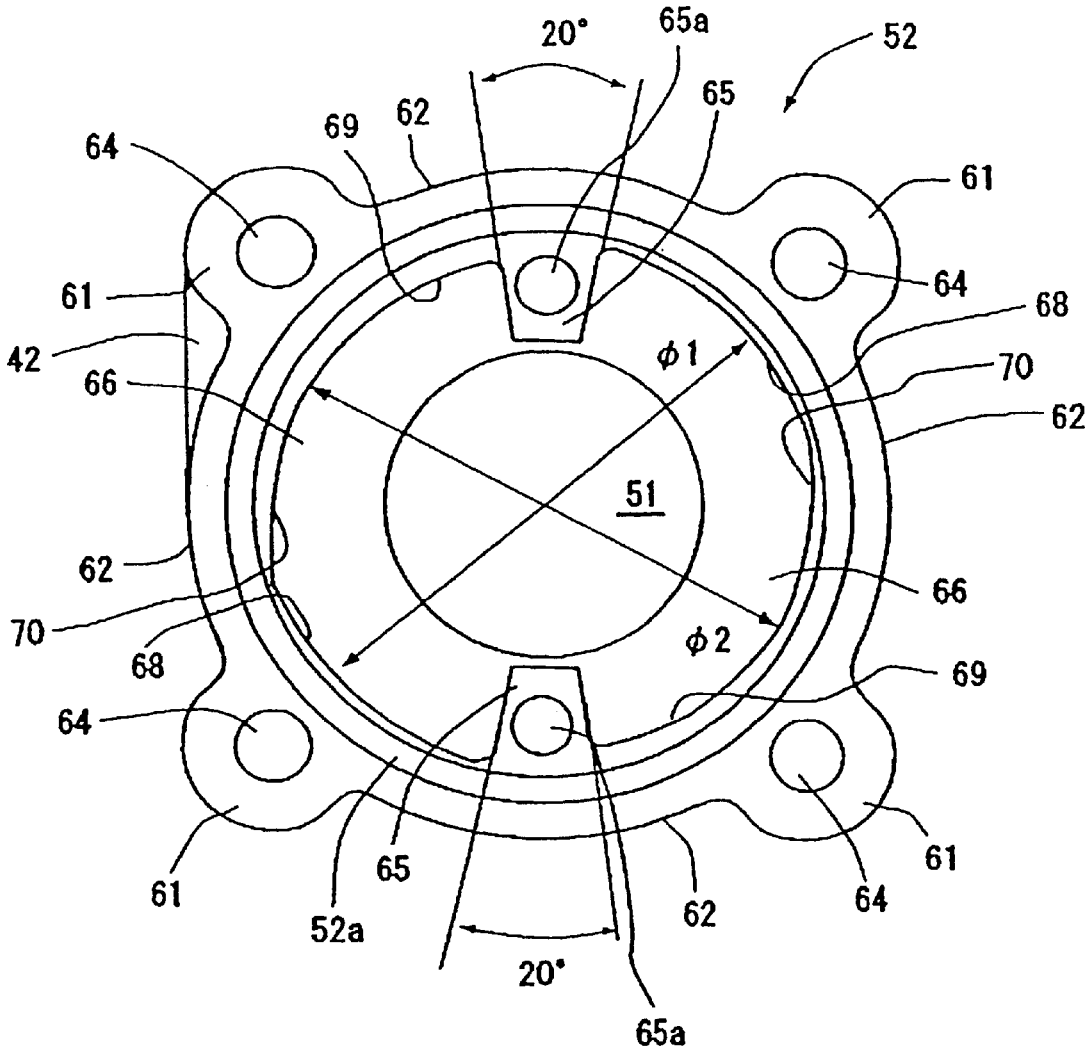
FIG. 5 is a front view of the inside of the casing of the damping device used in the toilet seat/toilet lid unit of FIG. 1.

The casing 52, as shown in FIG. 5, has four protrusions 61 that constitute the screw fastening parts 41, four cylindrical parts 62 that connect with each of the protrusions 61, four screw holes 64 in which are inserted screws 63 for integrating the casing 52 and the cover 54, two protrusions 65 that extend radially so that they protrude and prevent movement of the liquid that has been discharged towards the center by virtue of abutting a cylinder 81 of the rotor 55, and oil space forming holes 66 for the purpose of providing a space for retaining the viscous oil 56.

A small-diameter protrusion 67 that protrudes slightly outwards is provided outside the hole 51 in order to reduce the surface area of contact with the toilet seat hinge 13, to link with the attachment casing 21, and to effect positioning. In addition, a circular protrusion 52*a* for linking with the cover 54 is provided on the side of the cover 54, and cylindrical protrusions 65*a* are provided on the tips of the protrusions 65 on the side of the cover 54. In addition, the screw 63 is a self-tapping screw (i.e., the screw groove is formed by itself). Fastening of the casing 52 and the cover 54 may be carried out by fastening via ultrasonic welding, rather than with a screw.

The tips of the protrusions 65 on the side of the rotor 55 have a rounded tooth-like surface so that they may make contact with the core 81 of the rotor 55. The circumferential width of the protrusions 65 is set to span an angle of 20 degrees. In addition, as shown in FIG. 5, the hole 66 for forming the oil space has large hole diameter regions 68 that form spaces with the movable valve 57 due to the large hole diameter $\phi$1, and small hole diameter regions 69 that are in close contact with the movable valve 57 and constitute a diameter $\phi$2 smaller than that of the large hole diameter regions 68.

Both the large hole diameter regions 68 and the small hole diameter regions 69 are disposed with a center of symmetry at the center of the axis of rotation of the rotor 55. In addition, in this embodiment, the hole diameter $\phi$1 is 18 mm, and the range thereof is about 60 degrees. On the other hand, the hole diameter $\phi$2 is 12 mm, and the range thereof is about 75 degrees. Thus, the connecting regions 70 that connect the large hole diameter regions 68 and the small hole diameter regions 69 are straight lines, and have ranges of about 25 degrees.

Figure 6:
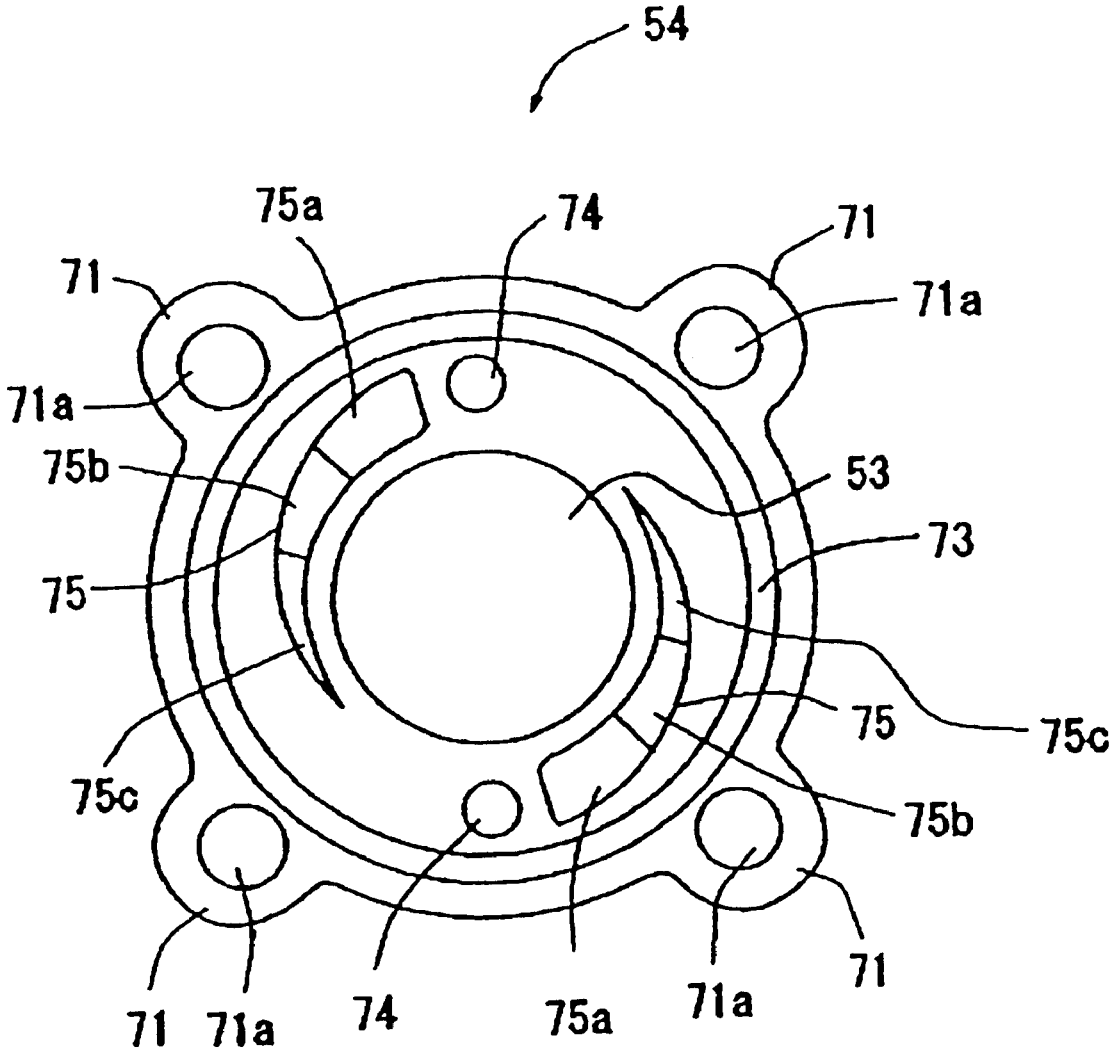
FIG. 6 is a front view showing the inside of the cover of the damping device used in the toilet seat/toilet lid unit of FIG. 1.

The cover 54, as shown in FIG. 6, has a hole 53, as well as four protrusions 71 that constitute a screw fastening part 41, four screw holes 71 a for fastening screws 63 to the protrusions 71. In addition, as shown in FIG. 3, the cover 54 has a small diameter protrusion 72 that protrudes slightly outwards in order to decrease the surface area of contact with the toilet seat hinge 13 so that rotation with the toilet seat hinge 14 or toilet lid hinge 15 may occur smoothly. The cover 54 also has a circular groove 73 in which an O-ring 60 and the circular protrusion 52*a* of the casing 52 may be inserted, two circular cavities 74 in which cylindrical protrusions 65*a* fit, and two cavities 75 that gradually narrow in the direction of damping. Here, the direction of damping ("damping direction") is the direction of rotation of the rotor 55 which gives an increased damping force (controlling force).

The cavities 75 are provided with point symmetry on the end surfaces in the axial direction on the inside of the cover 54. In addition, each of the cavities 75 has a deep cavity 75*a* that is the deepest and is present at the end, a medium cavity 75*b* of medium depth, and a shallow cavity 75*c* that is the shallowest. The deep cavity 75*a* is the widest, and the shallow cavity 75*c* is the narrowest, with the width of the tip being zero. In this embodiment, the depth of the deep cavity 75*a* is 2 mm, the depth of the medium cavity 75*b* is 1.5 mm, and the depth of the shallow cavity 75*c* is 1.0 mm. In addition, the cavities are formed so that the length of each of the cavities 75 in the circumferential direction spans an angle of about 110 degrees. In addition, a gate (not shown) is provided in the center cavity 75*b* during resin molding, so that the gate does not protrude to the surface.

Figure 7:
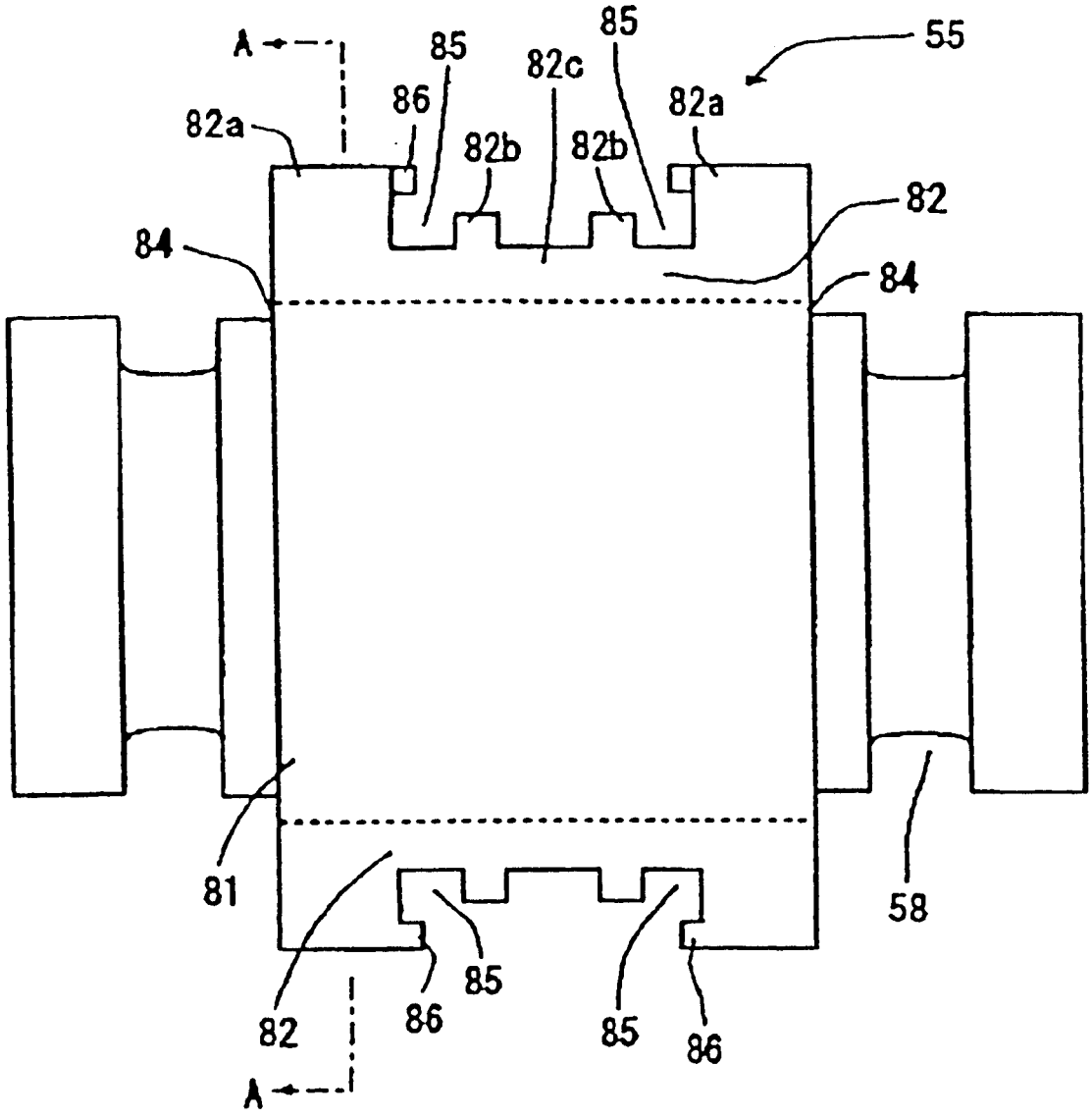
FIG. 7 is a front view showing the rotor in a condition in which the movable valve of the damping device used in the toilet seat/toilet lid unit of FIG. 1 has been removed.

The rotor 55 has two movable valves 57 described below. In addition, as shown in FIGS. 7 and 8, the rotor 55 has grooves 58 in which O-rings 59 are inserted, a cylindrical core 81 against which the protrusions 65 of the casing 52 may contact while allowing it to move, two damping protrusions 82 to which the movable valves 57 are linked, the damping protrusions 82 being provided so that they protrude outwards from the core 81, an insertion hole 83 that opens along the line of the center axis of the core 81 through which the support shaft 19 is inserted, and protruding contact portion 84 that are respectively contacted by the casing 52 and the cover 54.

Figure 9A:
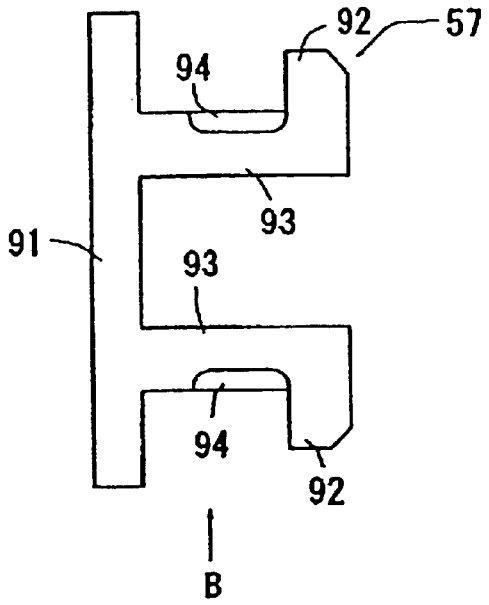
FIGS. 9(A) and (B) show the movable valve of the rotor part for the damping device used in the toilet seat/toilet lid unit of FIG. 1, where
Figure 9B:
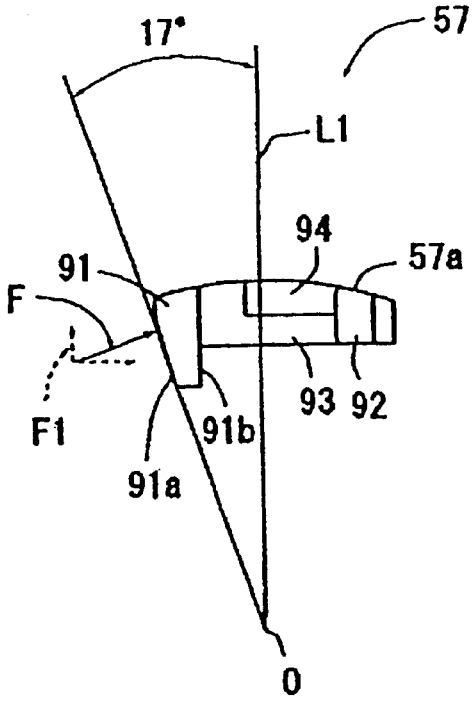

The respective damping protrusions 82 each have a groove 85 in which the arm 93 of the movable valve 57 is inserted as shown in FIGS. 9(A) and (B), and a latching protrusion 86 that is inserted into the cut-out recess 94 of the movable valve 57, and serves as a retaining part for preventing exit of the movable valve 57. Each of the grooves 85 is formed by an outer large protrusion 82*a*, an inner small protrusion 82*b* and a base 82*c* for the damping protrusion 82. The latching protrusion 86 is integrated into the width in the circumferential direction of the large protrusion 82*a* so that it slightly protrudes laterally with respect to the surface of the inside of the tip of the large protrusion 82*a*.

Figure 8:
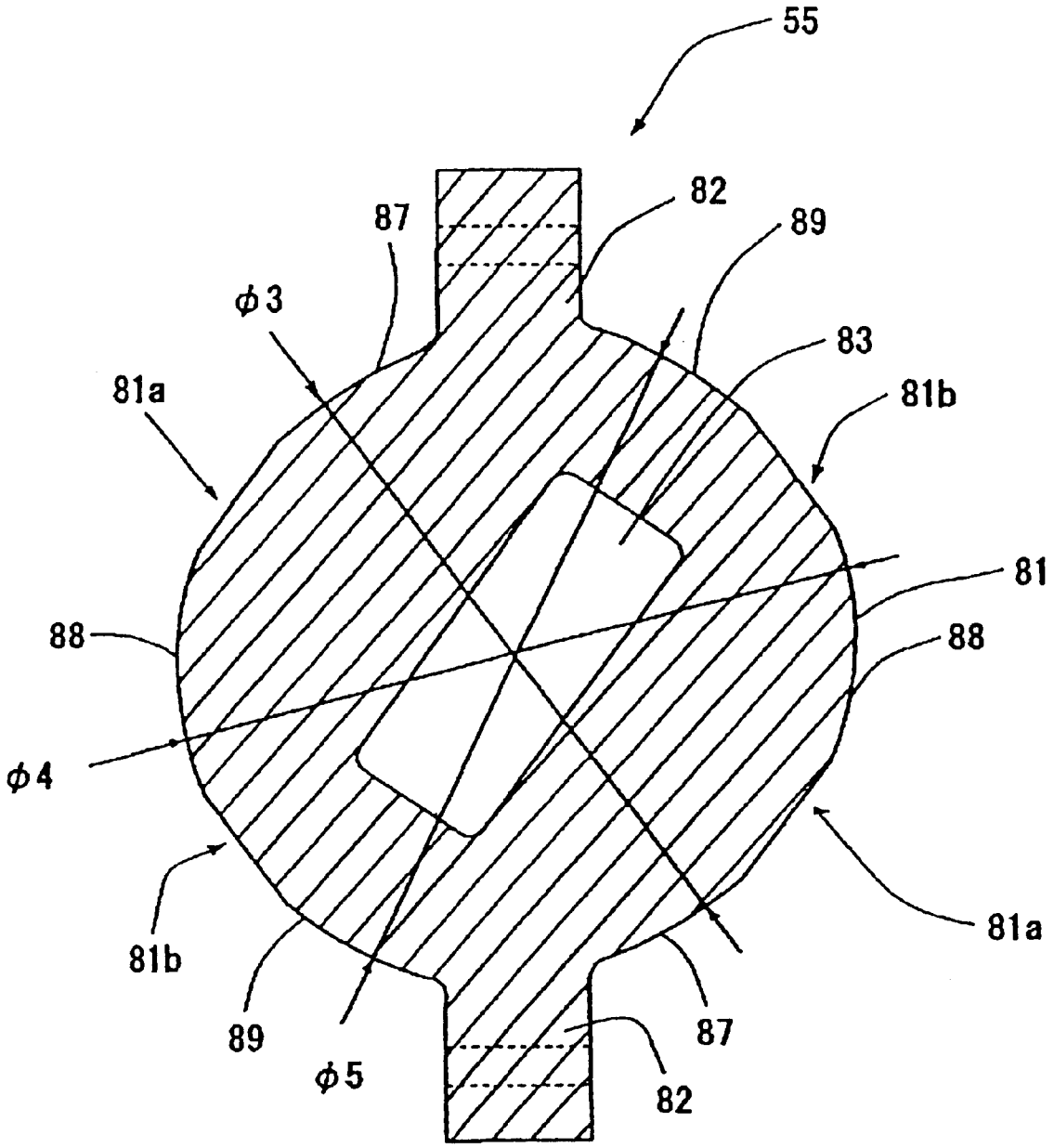
FIG. 8 is cross-sectional view along the line A—A in FIG. 7.
Figure 11A:
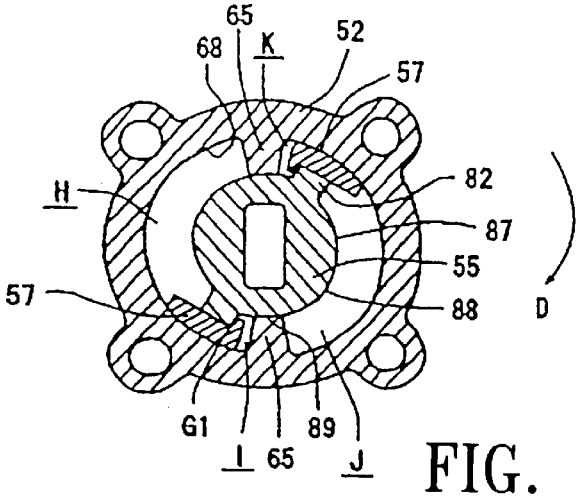
FIGS. 11(A)–(C) illustrate the function of the damping device used in the toilet seat/toilet lid unit of FIG. 1, where
Figure 11B:
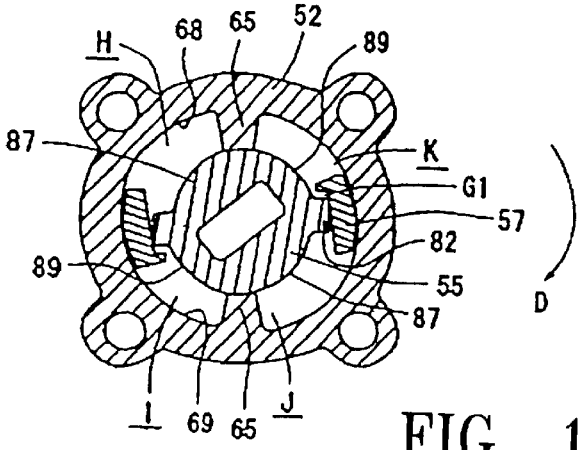
Figure 11C:
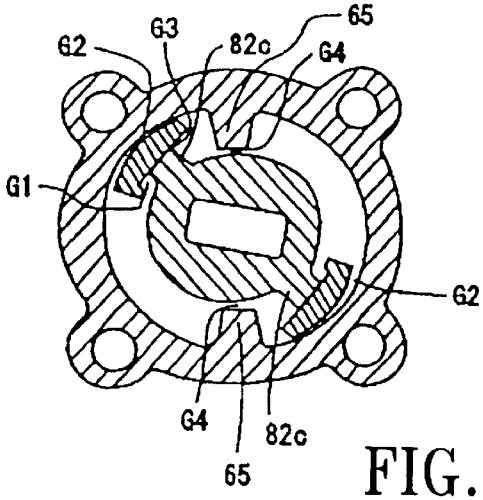

The core 81 of the rotor 55, as shown in FIG. 8, is disposed with its center of symmetry at rotation axis of each of the rotors 55, and is divided into regions of three different diameters: small-diameter regions 87, medium-diameter regions 88, and large-diameter regions 89. The small-diameter regions 87 are the regions with the smallest diameter, and when the toilet seat 11 is open (in the raised condition), they are the regions that are opposite the protrusions 65. At this time, as shown in FIG. 11(C), a small gap G4 is present between the protrusions 65 and the small-diameter regions 87, and the viscous oil 56 may move through the gap G4.

The medium-diameter regions 88 are regions having a somewhat larger diameter than that of the small-diameter regions 87, and are the regions that are opposite the protrusions 65 when the toilet seat 11 is somewhere between the open and closed positions. At this time, as shown in FIG. 11(B), there is no gap between the protrusions 65 and the medium-diameter regions 88, as by design, the inner diameters of the protrusions 65 are the same as the outer diameters of the medium-diameter regions 88. The damping protrusion 82 of the rotor 55 is formed so that the protrusion 65 is opposite the medium-diameter region 88 approximately when movement occurs from the large hole diameter region 68 to the small hole diameter region 69 of the casing 52.

The large-diameter regions 89 are regions with diameters that are slightly larger than the that of medium-diameter regions 88, and are the regions that are opposite the protrusions 65 in the period from immediately prior to closing of the toilet seat 11 to complete closure. With the large-diameter regions 89, as shown in FIG. 11(A), the protrusions 65 dig into the large-diameter regions 89 and apply a large braking force to the rotor 55.

In this embodiment, the diameter ϕ3 of the small-diameter region 87 is 11.2 mm, the diameter ϕ4 of the medium-diameter region 88 is 12 mm, and the diameter ϕ5 of the large-diameter region 89 is 12.35 mm. In addition, the connection region 81*a* of the small-diameter region 87 and the medium-diameter region 88 and the connection region 81*b* of the medium-diameter region 88 and the large-diameter region 89 are both straight lines. In this manner, the outer circumference of the core 81 is non-circular in that it is formed of arcs and straight lines. An elliptical shape wherein the diameter gradually increases or some other non-circular shape may also be used. In this embodiment, the angle of the small-diameter region 87 is about 40 degrees, the angle of the medium-diameter region 88 is about 45 degrees, and the angle of the large-diameter region 89 is about 45 degrees, with the angle for each of the connection regions 81*a*, 81*b* being about 15 degrees.

The insertion hole 83 of the rotor 55 forms a passage hole through which the rotor 55 passes along the axis of rotation. In addition, the cross-sectional shape of the or insertion hole 83 is elongated with all of the four comers being circular curved lines. This shape is similar to the cross-sectional shape of the support shaft 19.

The viscous oil 56 is used to provide a damping action, or a buffering action, for the damping device 22. This action is manifested by applying a resistive force with respect to rotation of the rotor 55. In this embodiment, silicone oil is employed as the viscous oil 56, but other types of oil may also be used.

Figure 10:
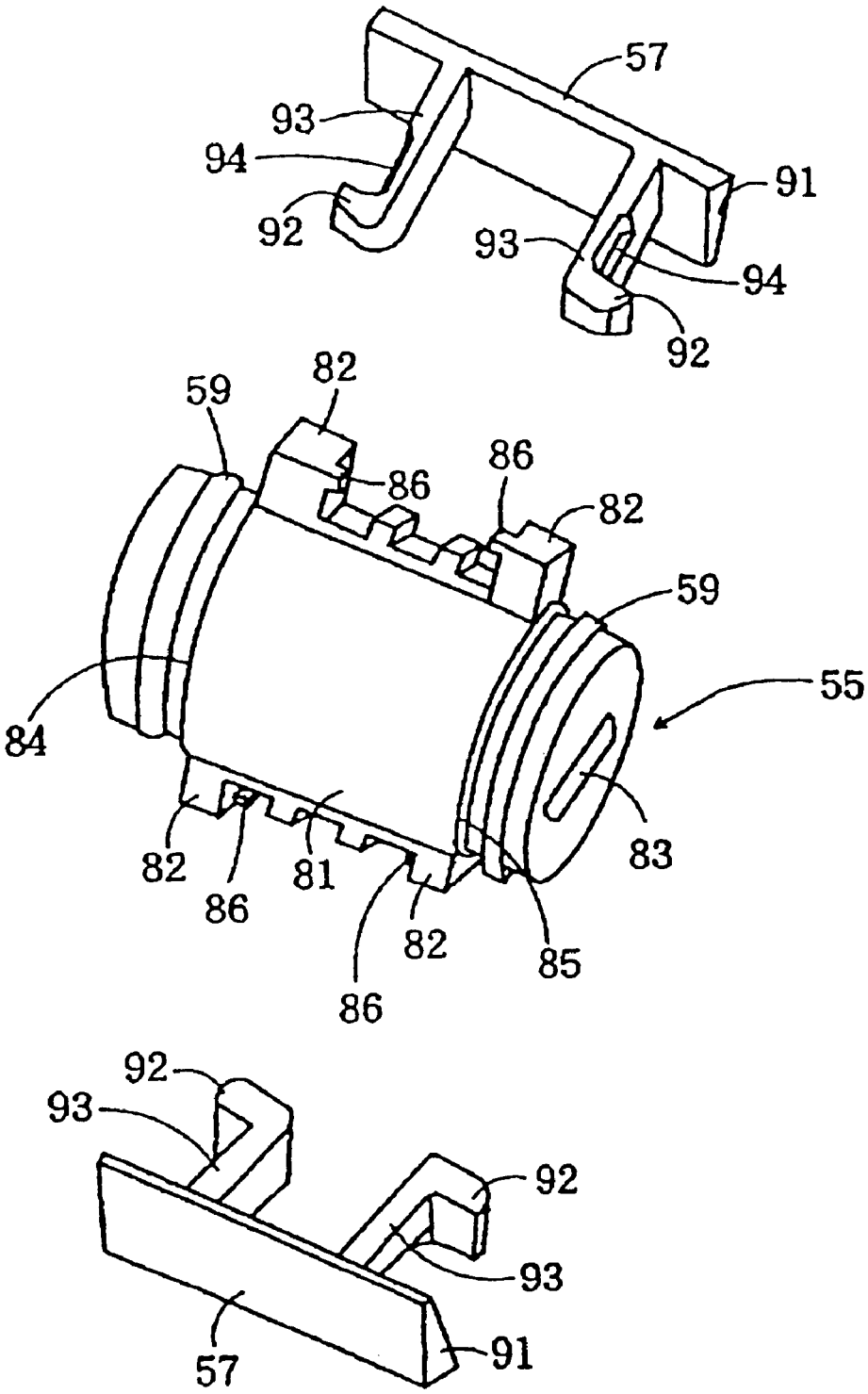
FIG. 10 is an exploded perspective view of the rotor part of the damping device used in the toilet seat/toilet lid unit of FIG. 1.

As shown in FIG. 11, the two movable valves 57 have the same shape, and are situated symmetrically about one point, with the axis of rotation of the rotor 55 as the center. The movable valve 57, as shown in FIG. 9 and FIG. 10, includes an oil impingement part 91 with a triangular cross section, and two arms 93 having two hooks 92 at their respective tips that stop the exit of the movable valve 57 from the damping protrusion 82 due to the motion in the circumferential direction of the movable valve 57. The arms 93 are equipped with cut-out recesses 94 in which the latching protrusion 86 (see FIG. 7) of the rotor 55 is inserted.

The oil impingement part 91 serves as a pressure part that is acted upon by the pressure of the viscous oil 56 which is a liquid. The front surface of the oil impingement part 91 constitutes the pressure surface 91*a*, and when the viscous oil 56 impinges thereupon, the movable valve 57 becomes an inwardly-slanting surface so that compression force is produced on the side of the casing 52. The pressure surface 91*a* in this embodiment is the surface that faces the center O of the rotor 55, and is a surface that has an aperture of 17 degrees from the center line L1 of the movable valve 57. Moreover, the upper surface 57*a* of the movable valve 57 constitutes a curved surface having a radius of curvature of 9.5 mm, and is identical to the shape of the curved surfaces of the large hole diameter regions 68 of the casing 52.

The movable valve 57 may move slightly back and forth in the circumferential direction with respect to the damping protrusion 82. This shifting occurs due to the relative movement of the latching protrusion 86 in the cut-out recess 94. When the rotor 55 moves in the direction indicated by the arrow C in FIG. 4 (the closing direction), the pressure surface 91*a* of the oil impingement part 91 of the movable valve 57 impinges upon the viscous oil 56, and the back surface 91*b* of the oil damping part 91 impinges upon the damping protrusion 82, so that movement towards the casing 52 occurs due to the upwards component force F1 (FIG. 9(B)) of the resistance force F of the viscous oil 58. When this happens, the viscous oil 56 present in the direction of frontward rotation of the oil impingement part 91 does not have any space to retreat, and thus a force is generated that stops rotation of the rotor 55. This constitutes a part of the damping force (buffering force, or controlling force).

On the one hand, when the rotor 55 rotates in the direction indicated by the arrow D in FIG. 4, in other words, when the toilet seat 11 is moved in the open direction, the back surface 91*b* of the oil impingement part 91 of the movable valve 57 is acted upon by a resistance force from the viscous oil 56, and by this means, the reverse surface 91*b* of the oil impingement part 91 is separated from the damping protrusion 82. As a result, the viscous oil 56 present in front of the rotational direction of the oil impingement part 91 passes through the gap formed between the reverse surface 91*b* of the oil impingement part 91 and the damping protrusion 82, so that it moves in a direction opposite to the direction of rotation. As a result, little or no damping force is generated, and the toilet seat 11 may be moved towards the open direction with light force.

The damping device 22 is left-right symmetrical in terms of its external shape, with a line perpendicular to the center axis as the line of symmetry, excluding the positioning protrusion 42. For this reason, by changing the position of the positioning flat surface 35, the part may be used as the damping device 22 that has the reverse damping direction.

Support shafts 19 and 20 are made from the same member, and as shown in FIG. 22, have a long and thin shape. The cross-sectional shape of the support shafts 19 and 20 is elongated, with the four corners being circular curves. A beveled part 95 that is beveled around its entire circumference is provided at both ends of each of the support shafts 19 and 20, and each of the ends has an elongated form with a diameter that is slightly smaller than the elongated cross-section. Both ends 96 of both support shafts 19 and 20 provide supports for the respective toilet seat hinge 13 and toilet lid hinge 15, and in addition, provide supports for the toilet seat hinge 14 and toilet lid hinge 16.

Specifically, as shown in FIGS. 1 and 2, support shafts 19 and 20 are inserted into the insertion holes 83 through which the rotors 55 pass in the axial direction. One end of the support shaft 19 is connected with the hole 26 of the toilet seat hinge 13 so that it may rotate as a unit therewith, and the other end is linked to a hole with a circular cross section of the toilet lid hinge 15 so that the support shaft may rotate along with the rotor 55. On the other hand, one end of the support shaft 20 is linked with the hole 29 of the toilet lid hinge 16 so that it may rotate as a unit therewith, and the other end is linked to a hole 27 with a circular cross section in the toilet seat hinge 14 so that the support shaft may rotate along with the rotor 55. By this arrangement, movement of the toilet seat 11 in the closing direction is damped by the first damping device 22, and movement of the toilet lid 12 in the closing direction is damped by the second damping device 24.

As described above, insertion holes through which the support shafts pass are provided, and the same toilet damping device may be used for the right and left sides. Insertion of the support shafts is thus possible, in spite of the fact that the direction in which the support shafts are inserted is different on the right and left sides. As a result, right and left toilet damping devices having the same shape may be used, even if there are requirements in terms of shape for the toilet. Because toilet seat damping devices that have the same shape may be used, error-free installation will be made easier. Moreover, the cost of the toilet damping device is reduced.

Various methods may be used to assemble the first and second dampers 17 and 18. A preferred method is described here. First, as shown in FIG. 1, the two damping devices 22, 24 are assembled in the two attachment casings 21, 23. Next, dampers 17 and 18 are inserted between the respective toilet seat hinge 13 and toilet lid hinge 15, and the toilet seat hinge 14 and toilet lid hinge 16, and the support shaft 19 is inserted in the direction of the arrow A in FIG. 2. The support shaft 20 is then inserted in the direction indicated by arrow B in FIG. 2. Assembly of the toilet seat/toilet lid unit 1 is thereby completed. Screws are then fed into the attachment holes 32 for dampers 17 and 18, and the toilet seat/toilet lid unit 1 is attached to the toilet body by fastening with screws.

The operation of the toilet with attached toilet seat/toilet lid unit 1 and the rotational action of the toilet seat 11 and toilet lid 12 is described below with reference to the operation of the first and second damping devices 22, 24.

The toilet seat 11 and toilet lid 12 are initially closed. When a user starts to rotate the toilet seat 11 and toilet lid 12 towards the tank, the rotors 55 of the two damping devices 22, 24 rotate in the direction of the arrow D in FIG. 11(A). Specifically, the rotors 55 rotate from the position shown in FIG. 11(A) towards the position indicated in FIGS. 11(B) and 11(C).

In addition, the gap G2 between the inner circumferential surface of the casing 52 and the movable valve 57 gradually increases from zero. A gap G3 is produced between the movable valve 57 and the base 62*c* of the damping protrusion 82. For this reason, the viscous oil 56 that is present in the spaces H and J passes through the small protrusions 82*b*, 82*b*, and escapes into spaces I and K from the gap G1. In addition, some of the liquid also passes through the gaps G2, G3. As a result, the viscous oil 56 in the spaces H and J is not under substantial pressure, and the resistance force is small. In other words, the viscous oil 56 is not blocked by the movable valve 57, and almost no resistance force is applied. The toilet seat 11 and toilet lid 12 may thus be opened with a light force.

In addition, the core 81 of the rotor 55 and the protrusions 65 are initially in a compressed state as shown in FIG. 11(A). Subsequently, as shown in FIG. 11(B), they assume a condition of simple contact. Finally, a large gap G4 is generated between them as shown in FIG. 11(C). For this reason, rotation of the rotor 55 is initially slightly controlled, but a condition is soon produced wherein there is no regulation, and as described above, the toilet seat 11 and toilet lid 12 continue to be opened with light force. Subsequently, after rotating over about 100 degrees, the toilet lid and seat strike the tank and the rotation is stopped. Both of the damping devices 22 and 24 are constituted in such a manner that they may rotate over a range of about 120 degrees. This is because the angle in the circumferential direction of the protrusion 65 is 20 degrees, and the range in the circumferential direction of the movable valve 57 is about 40 degrees.

Figure 12A:
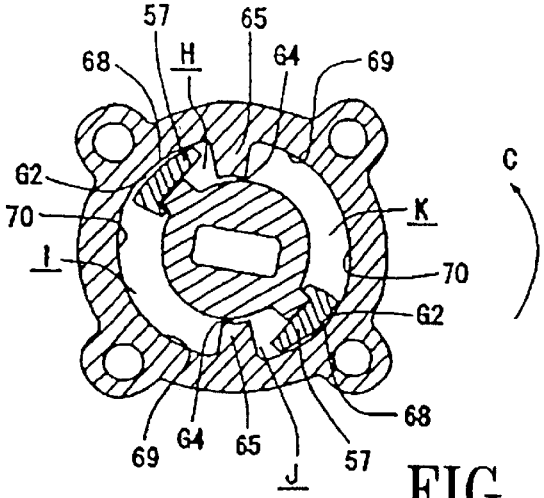
FIGS. 12(A)–(C) illustrate the damping device used in the toilet seat/toilet lid unit of FIG. 1, where

After using the toilet, when the toilet seat 11 and toilet lid 12 are rotated in the closing direction, both rotors 55 rotate in the direction indicated by the arrow C in FIG. 12(A). Initially, the movable valve 57 experiences resistance of the viscous oil 56 in the spaces I and K, and as shown in FIG. 12(A), moves in the opposite direction as that indicated by the arrow C, thus eliminating the gap G1. However, at this time, the movable valves 57 are opposite the large hole diameter regions 68 of the casing 52, and a gap G2 is formed with the movable valve 57. In addition, the protrusions 65 and the small-diameter regions 87 are opposite each other, and gaps G4 are produced between the two. As a result, the toilet seat 11 and toilet lid 12 move easily together. Due to the rotation of the regions in the C direction, the movable valve 56 experiences a component force F1 in the direction of the casing 52, and thus a gap G3 is generated between the damping protrusion 82 and the base 82*c* as before.

Subsequently, the movable valves 57 that have been provided for each of the rotors 55 begin to move opposite the small hole diameter region 69 of the casing 52, and the gap G2 between the two narrows, so that viscous oil 56 in the spaces I and K is compressed, and the resistance force of the viscous oil 56 increases. A damping force (buffering force) thus begins to act on the toilet seat 11 and toilet lid 12. Specifically, if the toilet seat 11 or toilet lid 12 is released from the user's hand at this stage, they will not free-fall to the closed position. At this time, the medium-diameter regions 88 of the rotors 55 contact the protrusions 65 as shown in FIG. 12(B), and the gap G4 is eliminated.

Subsequently, as the toilet seat 11 and toilet lid 12 are further rotated, and each of the rotors 55 move farther in the direction indicated by the arrow C, the movable valve 57 contacts the small hole diameter region 69 of the casing 52, and the gap G2 is completely eliminated, and the gap G3 also goes to zero due to the compressive force. For this reason, the viscous oil 56 in the spaces I and K is strongly compressed, and the resistance force further increases.

Due to this rotation, the large-diameter regions 89 of the rotors 55 begin to engage the protrusions 65, and a damping force is applied by the viscous oil 56, a breaking force thereby begins to act in this region. By this means, a strong damping force is exerted, and the toilet seat 11 and toilet lid 12 fall slowly even when released from the user's hand so that they do not strike strongly against the toilet body 1. For this reason, when the toilet seat 11 and toilet seat 12 are released from the hand while being closed, an impact sound will not be generated as with the conventional devices.

Figure 12B:
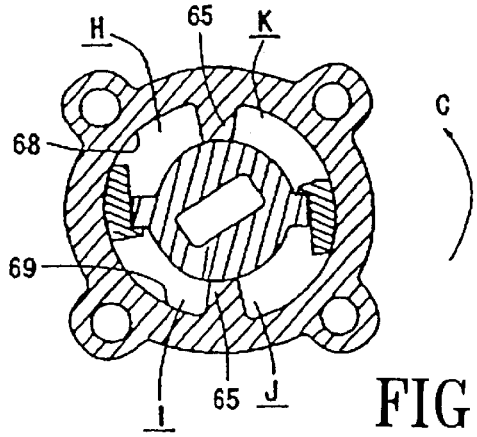
Figure 12C:
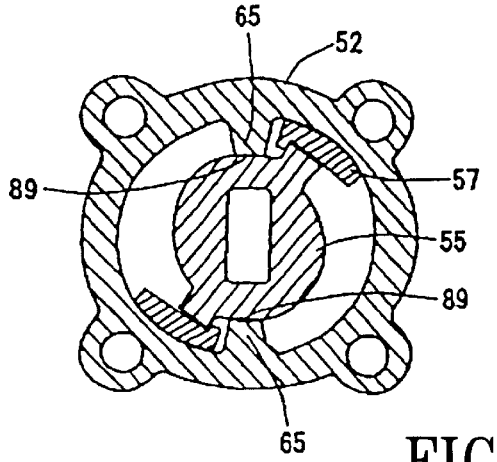

In transition from the position shown FIG. 12(B) to that shown in FIG. 12(C), when there are no escape locations, the viscous oil 56 in the spaces I and K moves in small amounts into the spaces H and J between small gaps such as the small gap between the movable valve 57 and the damping protrusion 82 of the rotor 55, the small gaps at various locations between the rotor 55 and casing 52 and the small gap between the protrusion 65 and the core 81. The resistance force at this time is large, and thus the toilet seat 11 and toilet lid 12 close slowly. They then close more rapidly as the resistance decreases.

Figure 13A:
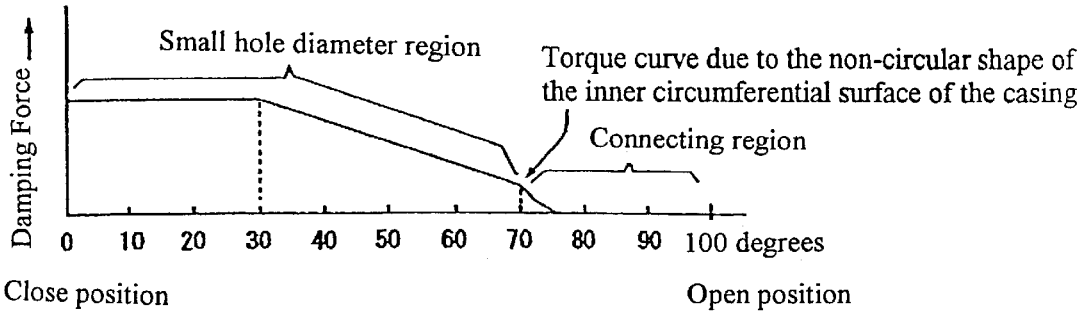
FIGS. 13(A)–(C) illustrate the relationship between the opening angle of the toilet seat and lid and the damping force (buffering force) of the damping device used in the toilet seat/toilet lid unit of FIG. 1, where
Figure 13B:
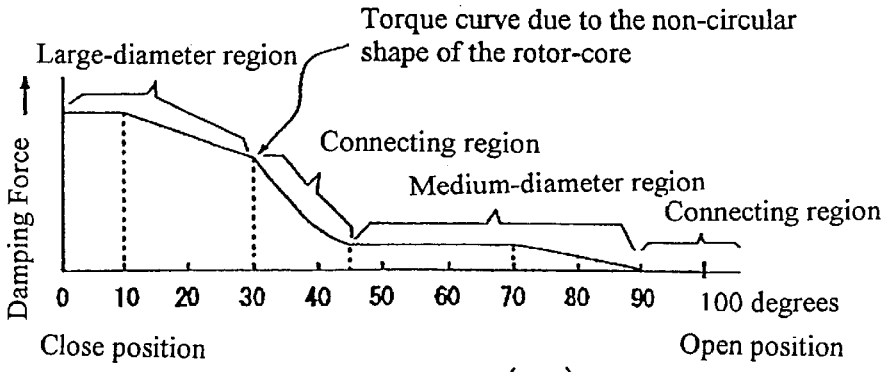
Figure 13C:
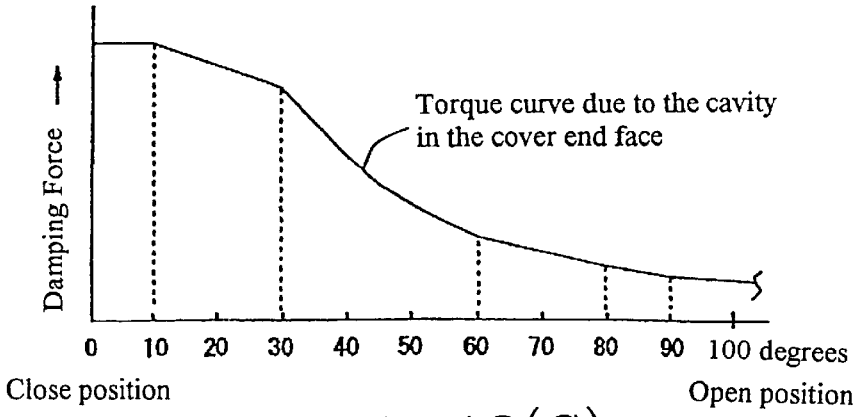

The condition of the damping force in each region is shown in FIGS. 13(A)–(C). The change in damping force is described with reference to FIGS. 13(A)–(C) and FIGS. 12(A)–(C).

The change in damping force due to the non-circular shape of the inner circumferential surface of the casing 52 is described first. As shown in FIG. 12A, in the open position (100 degrees), the movable valve 57 is opposite the large hole diameter region 68, and a condition is produced in which a gap G2 is present. For this reason, the damping force is zero, as shown in FIG. 13(A). Subsequently, the rotor 55 is rotated in the direction of the arrow C in FIG. 12(A), and the movable valve 57 begins to oppose the connecting region 70. When the toilet seat 11 and lid 12 reach the position where they are 75 degrees open, the front end of the movable valve 57 begins to contact the connecting region 70, and the damping force begins to act. When the rotor 55 rotates and additional 5 degrees, it begins to contact the small hole diameter region 69.

When the opening angle of the outer circumference of the movable valve 57 reaches about 40 degrees, it begins to contact the small hole diameter region 69, and from this point on, the surface contact area continues to increase gradually, and the damping force increases with a constant slope in conjunction therewith. Thus, when the opening angle of the toilet seat 11 and lid 12 reaches 30 degrees, the entire surface of the movable valve 57 contacts the small hole diameter region 69, and consequently, a constant torque results. Because the inner circumferential surface of the casing 52 is non-circular, it is possible to obtain a torque curve whereby the damping force gradually increases. This torque curve resembles the curve for the angular moment during closing of the toilet seat 11 or toilet lid 12 when there are no damping members. Thus, when a damping force is applied by means of using a non-circular surface for the inner circumference of the casing 52, the toilet seat 11 and toilet lid 12 close gradually at a nearly constant rate regardless of the angle, and no sound of impact is produced.

The damping force produced due to the non-circular shape of the core 81 of the rotor 55 is described next. The torque curve at this time is shown in FIG. 13(B). The position when the toilet seat 11 or toilet lid 12 are open at an angle of 100 degrees is taken as the open position. This condition corresponds to the condition shown in FIG. 12(A). When the toilet seat 11 and lid 12 are rotated and the rotor 55 rotates in the direction indicated by the arrow C, after a rotation of 10 degrees, the protrusion 65 begins to contact the medium-diameter region 88 of the rotor 55. At this time, the gap between the medium-diameter region 88 of diameter $\phi$4 (FIG. 8) and the two protrusions 65 is constant, and thus almost no damping force is applied. However, as the surface area of abutment increases, the damping force continually increases in small amounts, and when the toilet seat 11 and lid 12 reach 70 degrees, the entire inner surface of the protrusion 65 is against the middle diameter region 88, so that the frictional force is constant over the subsequent range of about 35 degrees, thus producing a constant damping force.

The protrusion 65 then contacts the straight connecting region 81*b*, and the core 81 transitions to a compressed condition. As a result, the damping force continues to increase precipitously. The rotor 55 then rotates an additional 15 degrees, and when the opening angle of the toilet seat 11 and lid 12 become 30 degrees, the protrusion 65 begins to contact the large-diameter region 89. The surface area of contact with the large-diameter region 89 then increases gradually, and thus the frictional force increases at a constant ratio. The curved surface of the protrusion 65 then entirely contacts the large-diameter region 89, and the torque (the damping force) becomes constant. Because the core 81 of the rotor 55 is non-circular, a torque curve may be obtained wherein the damping force gradually increases. Thus, by making the core 81 of the rotor 5 non-circular, it is possible to obtain an opening torque curve that corresponds to the angular moment of the toilet seat 11 or toilet lid 12 for the damping force.

Figure 14:
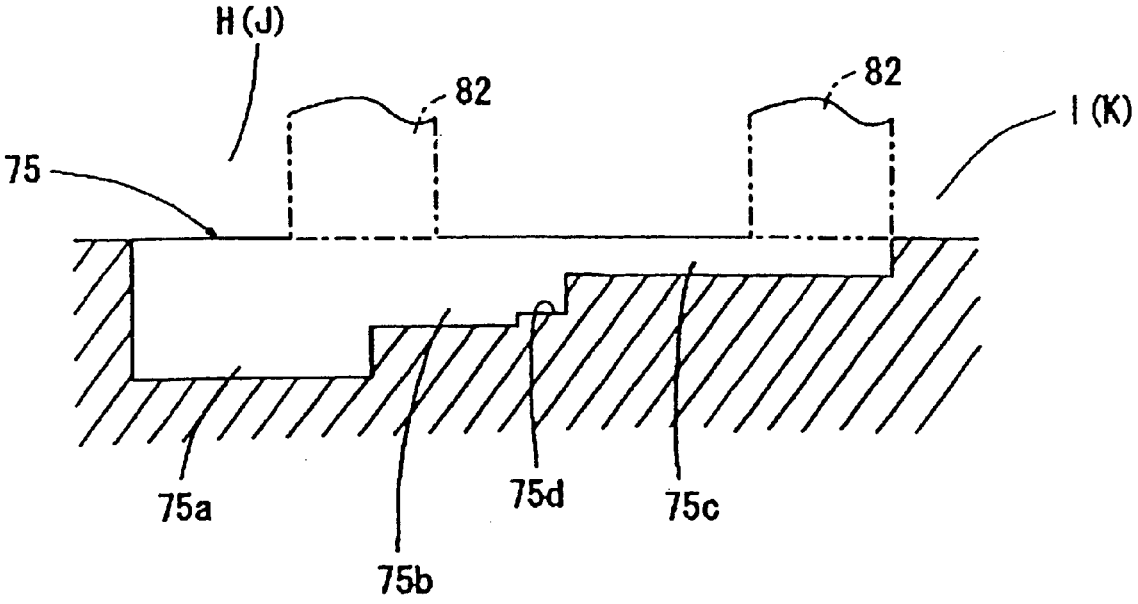
FIG. 14 is a cross sectional view along the circumferential direction of the cavity provided in the cover end surface of the damping device used in the toilet seat/toilet lid unit of FIG. 1.

Next, the damping force torque curve due to the cavity 75 provided at the end surface of the cover 54 will be described with reference to FIG. 13(C). When the toilet seat 1 is in the open position, the surface opposite the cavity 75 of the damping protrusion 82, as shown by the dotted lines in FIG. 14, is oriented so that it extends over the deep cavity 75*a* and the medium cavity 75*b*. For this reason, the viscous oil 56 in the spaces I and K passes through the cavities 75 and is transferred smoothly into the spaces H and J. As a result, as the opening angle of the toilet seat 11 and lid 12 move from 100 degrees to 90 degrees, the damping force is small, and the increase of the damping force is very slight. As the opening angle moves to 90 degrees, the damping protrusion 82 begins to move opposite the medium cavity 75, and the damping force increases slightly; but since the viscous oil 56 still moves smoothly, the damping force is fairly small.

Subsequently, when the open angle reaches 80 degrees, the damping protrusion 82 begins to move opposite the shallow cavity 75*c*, and the rate of increase in the damping force further increases. When the opening angle reaches 60 degrees, the damping protrusion 82 is completely opposite the shallow cavity 75*c*, and the movement of the viscous oil 56 is fairly restricted, so that the rate of increase in damping force is further increased. When the opening angle is near 30 degrees, the resistance approaches infinity based on the action of this cavity 75 alone; but since the viscous oil 56 in the regions I and K flows into the cavity 75 from the other gaps, the torque does not become infinite.

At an opening angle of 30 degrees, the damping protrusion 82 begins to move away from the cavity 75 as shown by the dotted lines in FIG. 14. At this time, the damping protrusion 82 and the end surface of the cover 54 are not completely in tight contact, and the viscous oil 56 in the spaces I and K may flow from the cavity 75 through the small gaps. This influx decreases as the damping protrusion 82 is further rotated. The damping force gradually increases. When the opening angle reaches 10 degrees, the damping protrusion 82 lies completely outside the cavity 75, and subsequently, the torque becomes fairly constant. By means of this cavity 75, a closing torque curve may be obtained that is in accordance with the angular moment of the toilet seat 11 or toilet lid 12.

From the individual torque curves produced by combining the three damping forces described above, a closing torque curve may be obtained that corresponds to the angular moment of the toilet seat 11 and toilet lid 12. By changing the non-circular shape of the casing 52, the non-circular shape of the rotor 55, the circular shape of the cavity 75 in the cover 54, or the viscosity of the viscous oil 56, it is easy to obtain closing torque curves that correspond to the rotational moments for various types of toilet seats 11 and toilet lids 12. Moreover, the damping force for each of the torque curves shown in FIGS. 13(A)–(C) are not shown in absolute values, in that each curve is a schematic curve used for purposes of illustrating torque trends.

When an user attempts to close only the toilet seat 11 after opening the toilet seat 11 and toilet lid 12, the seat hinges 13 and 14 rotate, but the toilet seat hinge 14 may move freely with respect to the support shaft 20. As a result, the second damping device 24 does not operate to damp the motion of the toilet seat 11. On the other hand, the toilet seat hinge 13 is linked so that it may rotate as a unit with the support shaft 19, so only the first damping device 22 generates damping force with respect to rotation towards the closed position of the toilet seat 11. At this time, the action of the first damping device 22 is similar to the action of the first damping device 22 described above when the toilet seat 11 and toilet lid 12 are closed simultaneously.

When the toilet lid 12 is to be closed while the toilet seat 11 in a closed state, the toilet lid hinge 15 may now move freely with respect to the support shaft 19, so the first damping device 22 does not generate a damping force for the toilet lid hinge 15. The other toilet lid hinge 16 is linked so that it rotates as a unit with the support shaft 20, so only the second damping device 24 generates a damping force with respect to rotation of the toilet lid 12 in the closing direction. The action of the second damping device 24 at this time is the same as the action of the second damping device 24 when the toilet seat 11 and toilet lid 12 are closed simultaneously.

Figure 15:
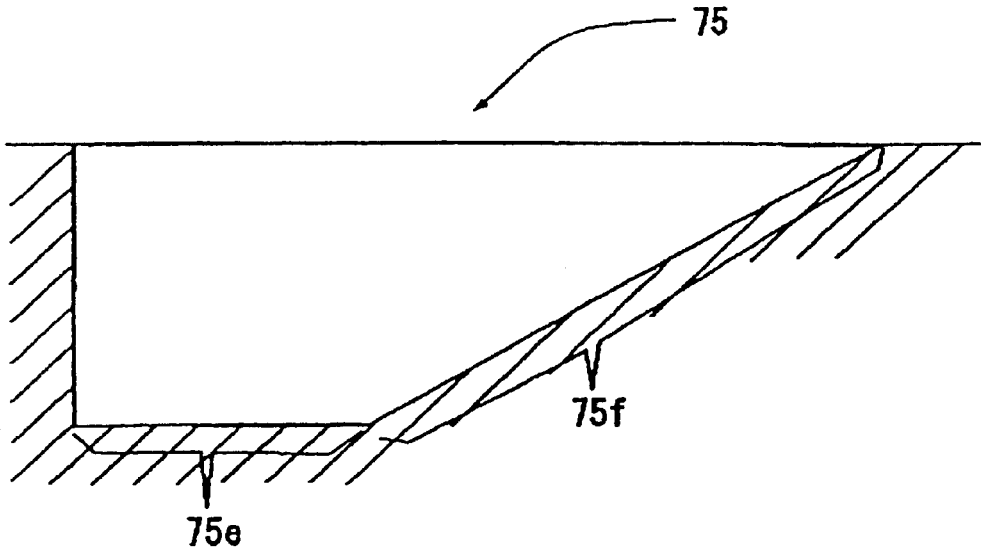
FIG. 15 is a cross sectional view showing an alternative cavity provided in the cover end surface of the damping device used in the toilet seat/toilet lid unit of FIG. 1.
Figure 16A:
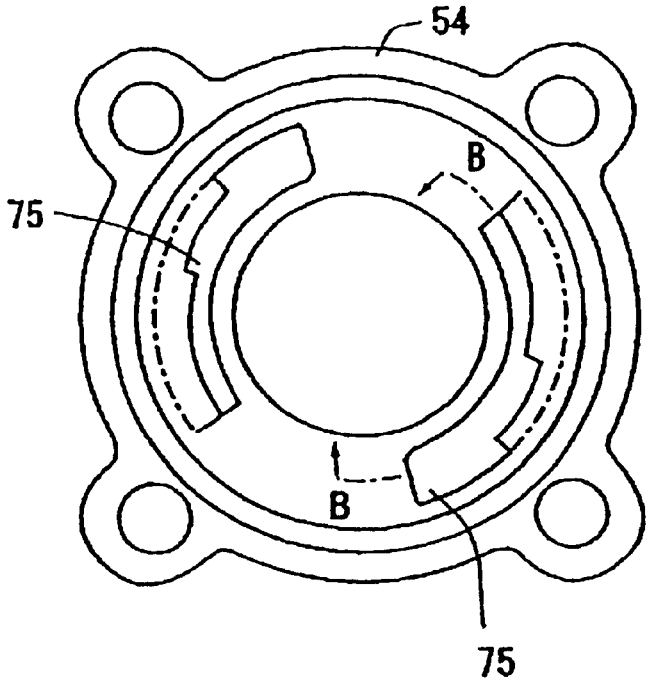
FIGS. 16(A) and (B) show an alternative cover of the damping device, where
Figure 16B:
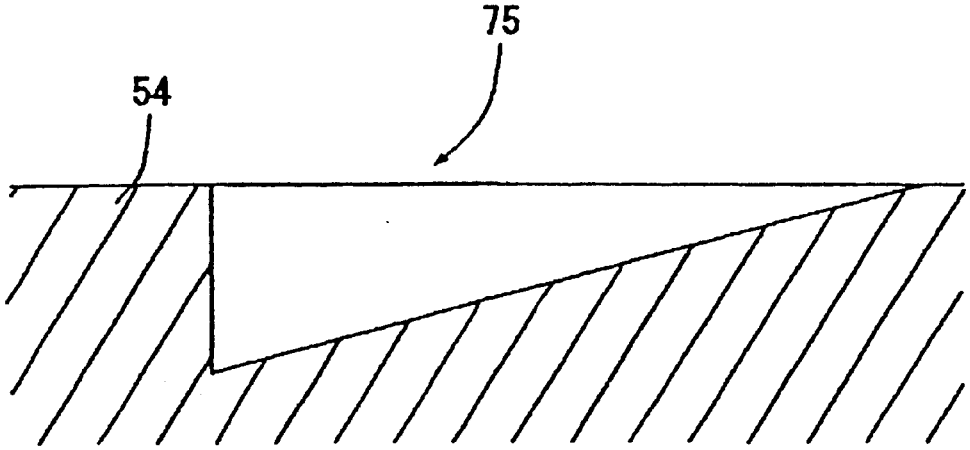
FIG. 16(B) is a partial cross-sectional view along the line B—B of FIG. 16(A).

The cross-sectional shape of the cavity 75 provided in the end surface of the cover 54, as shown in FIG. 15, has a deepest region 75*e* and a sloped region 75*f* with decreasing depth. Thus, a device is produced that has even better rotation-stopping feel with respect to the angular moment of the toilet seat 11 and lid 12. Moreover, as shown in FIGS. 16(A) and (B), the cavity 75 may be such that the width in the radial direction narrows step-wise, while the depth of the cavity 75 is gradually reduced. As shown by the single dotted line of FIG. 16(A), the width may be held constant while the depth is as shown in FIG. 16(B); or the depth may be held constant while either the width is narrowed in steps as shown in FIG. 16(A), or the width is gradually narrowed as shown in FIG. 6. The structures shown in FIGS. 14–16 or the structure described above may be employed in a damping device according to other embodiments of the present invention.

Figure 17:
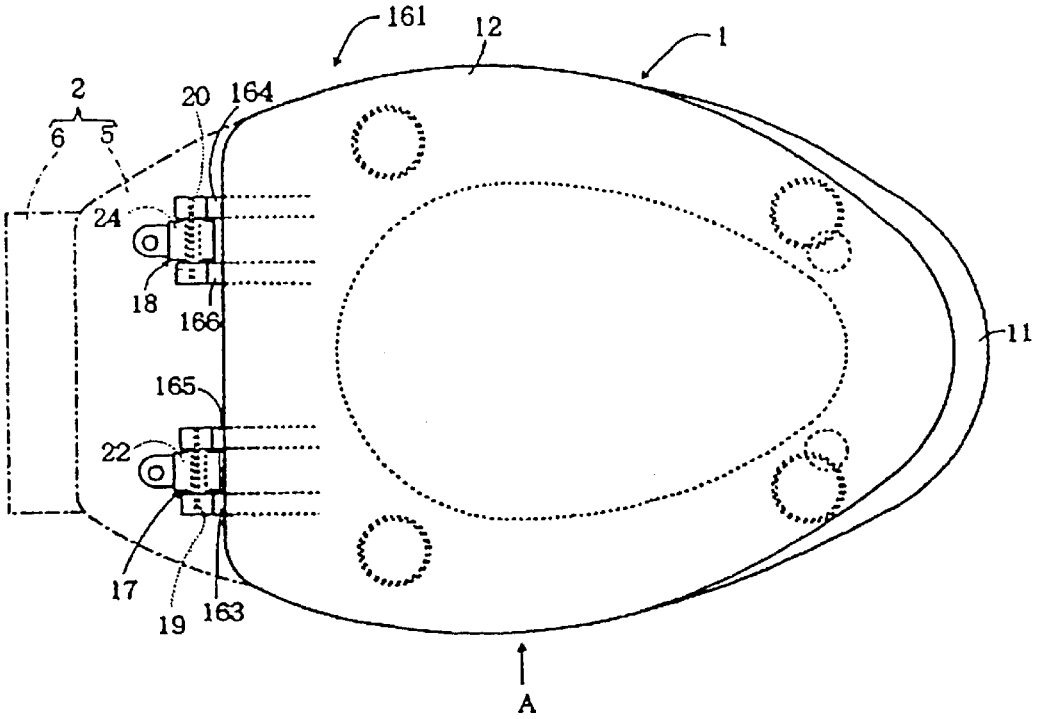
FIG. 17 is a plan view of a toilet seat/toilet lid unit according a second embodiment of the present invention.
Figure 18:
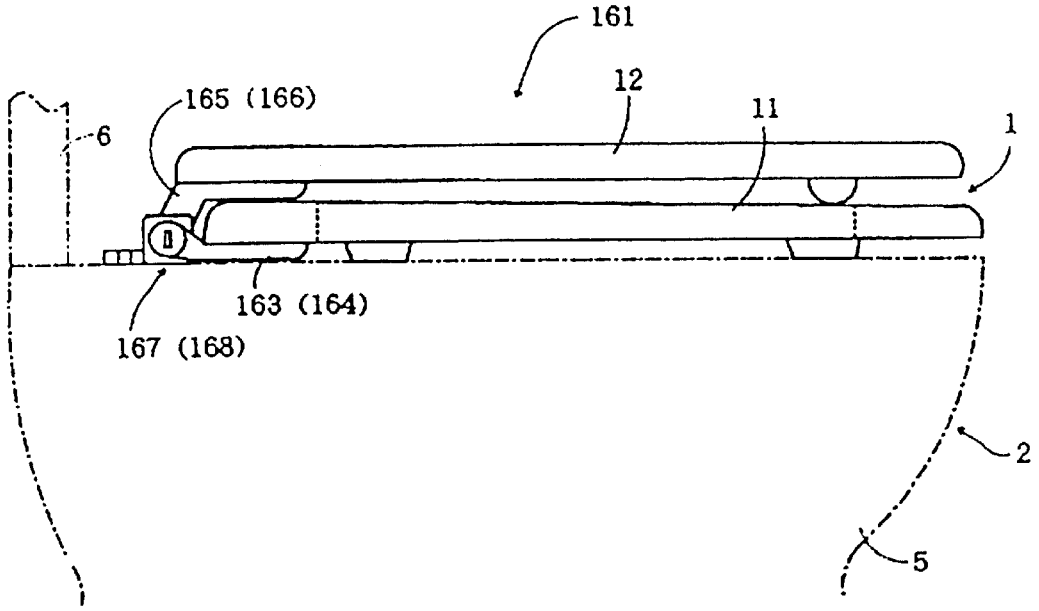
FIG. 18 is a side view of the toilet seat/toilet lid unit in FIG. 17 from the direction of the arrow A.
Figure 19:
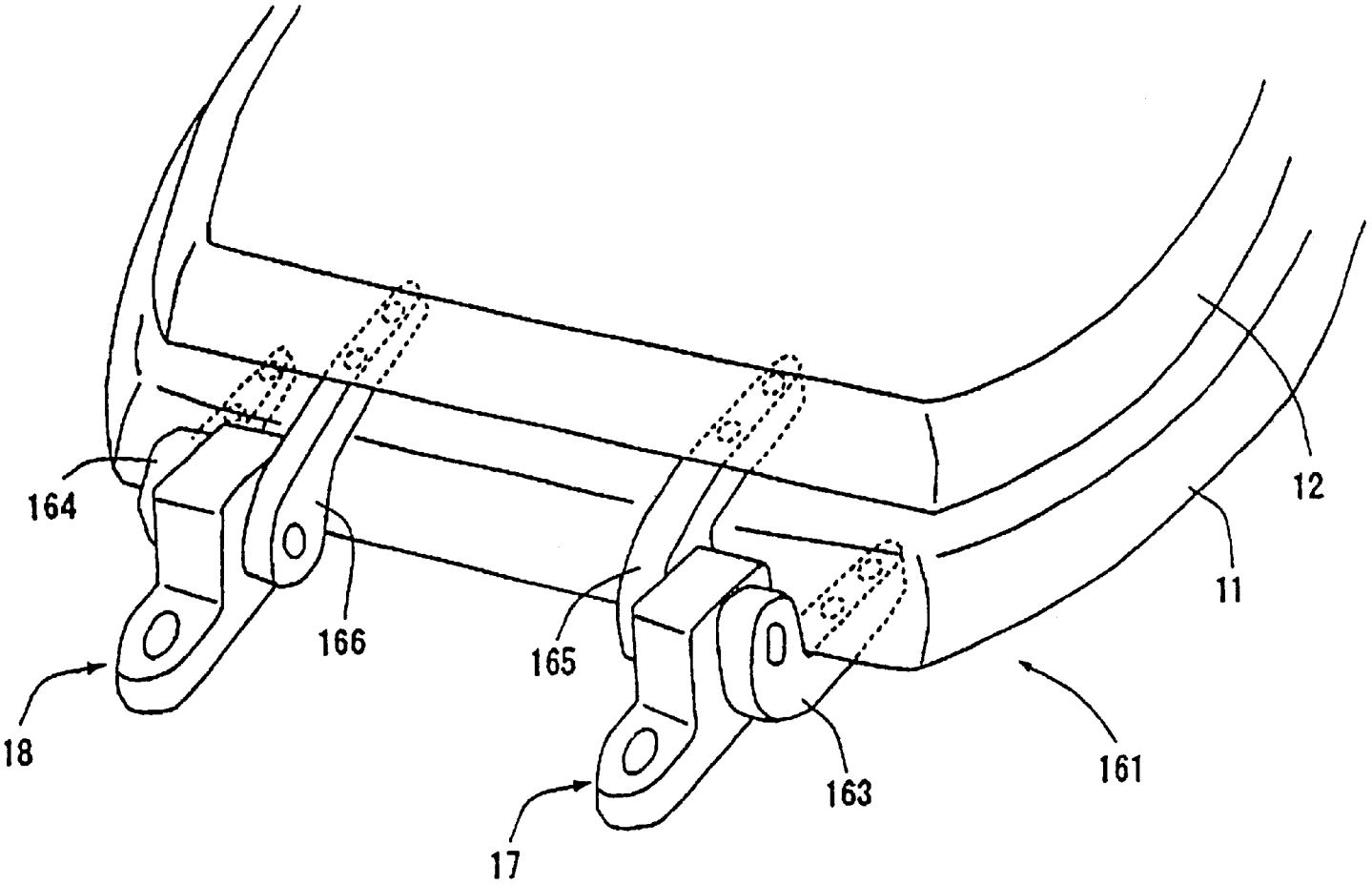
FIG. 19 is a perspective view of the toilet seat/toilet lid unit of FIG. 17.

The embodiment described above is a preferred embodiment of the present invention, but the invention is not restricted to this embodiment. Various changes may be implemented that are within the scope of the invention. For example, in the embodiment described above, the toilet seat hinges 13 and 14 are integrated with the toilet seat 11, and the toilet lid hinges 15, 16 are integrated with the toilet lid 12. However, as shown in FIGS. 17–19, a structure may be produced wherein the toilet seat 11 and the toilet seat hinges 163 and 164 are separate bodies, and the toilet lid 12 and the toilet lid hinges 165 and 166 are separate bodies, with the respective bodies being fastened with screws. In the FIGS., 163A, 164A, 165A and 166A designate screw holes.

In FIGS. 17–19, the toilet seat/toilet lid unit 161 is attached to a toilet body 2 which includes a main body 5 and a tank 6. Thus, the first damper 17 is installed between the toilet seat hinge 163 and the toilet lid hinge 165, and the second damper 18 is installed between the toilet seat hinge 164 and the toilet lid hinge 166.

In addition, in the embodiment described above, a structure may be produced wherein the attachment casing 21 and the casing 52 of the first damping device 22 are integrated, and the attachment casing 23 and the casing 52 of the second damping device 24 are integrated.

Figure 20:
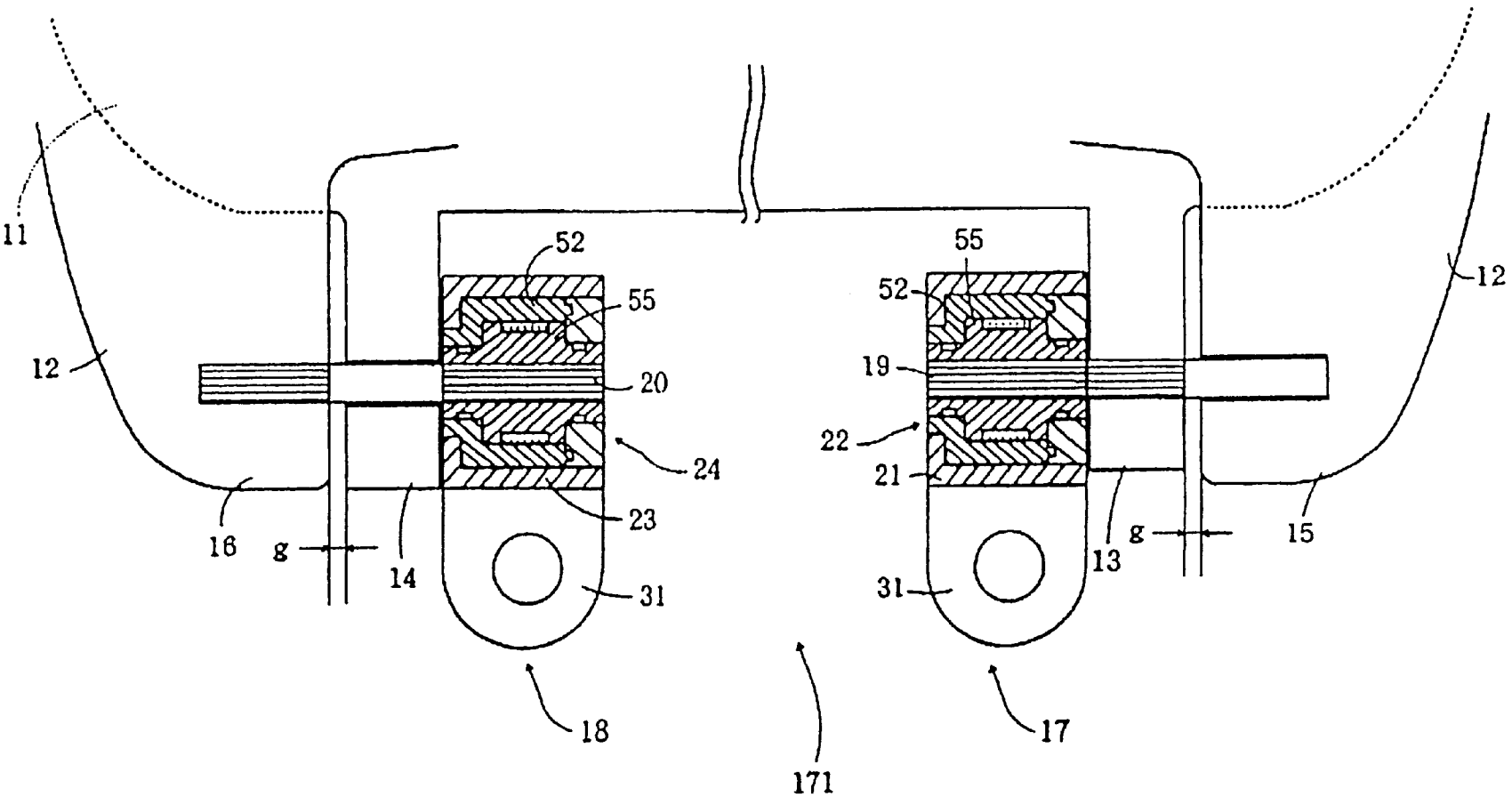
FIG. 20 is a top cross sectional view of a toilet seat/toilet lid unit according to a third embodiment of the present invention.

Moreover, the damping devices 22 and 24 need not be provided between the two hinges, as they may be provided on the insides of the two hinges (FIG. 20), or on the outside of the two hinges. With the toilet seat/toilet lid unit 171 of FIG. 20, the hinges 13 and 14 of the toilet seat 11 are disposed such that they are respectively sandwiched between the hinges 15 and 16 of the toilet lid 12 and both of the dampers 17 and 18. In addition, respective gaps g are provided between the hinges 13 and 15 and hinges 14 and 16 so that when the toilet seat 11 is moved in the closing direction, the action does not affect the toilet lid 12. In FIG. 20, a structure is shown wherein damping devices 22 and 24 are used. In order to facilitate understanding, horizontal lines are drawn to the parts whereby the rotor 55 of the support shafts 19 and 20 and the toilet seat hinge 13 and the toilet lid hinge 16 are linked so that they may rotate as a unit. This joining means that allows for integrated rotation may be an assembly having the type of elongated cross-sectional shape, or an assembly of a fitting hole and a support shaft that has a non-circular cross section, such as a serration joint.

Figure 21A:
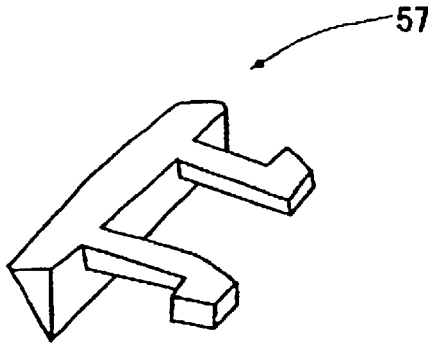
FIGS. 21(A)–(C) are perspective views of alternative embodiments of the movable valve used in the damping device of FIG. 1, where
Figure 21B:
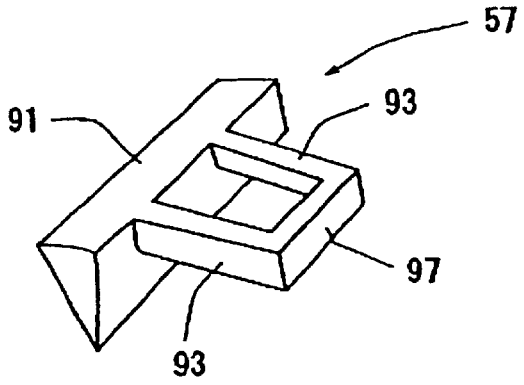
Figure 21C:
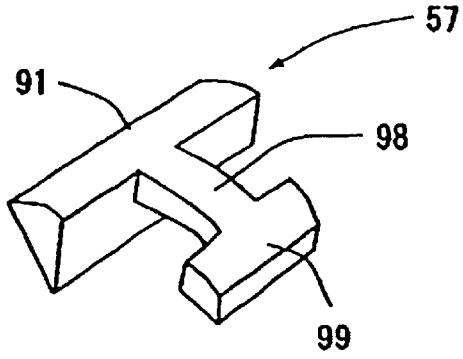
Figure 22A:
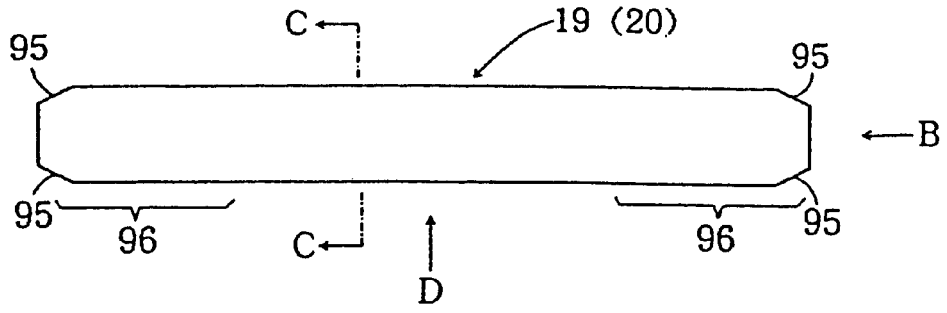
FIGS. 22(A)–(D) show a support shaft that passes through the damping device used in the toilet seat/toilet lid unit of FIG. 1, where
Figure 22B:
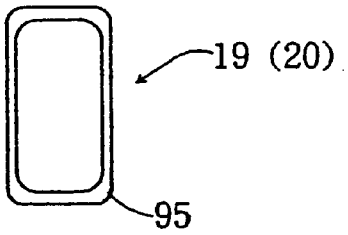
Figure 22C:
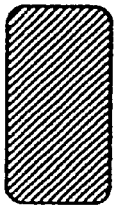
Figure 22D:
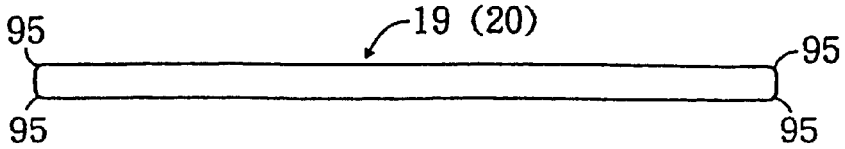

In addition, as shown in FIG. 21(A), the shape of the movable valves 57 and 116 need not include a cut-out recess 94, and the rotors 55 and 115 need not have a latching protrusion 86. Moreover, a structure may be formed wherein an arm 97 that connects with the arms 93 is provided, as shown in FIG. 21(B), or wherein a horizontal arm 99 is provided and extends sideways from the arm 98, as shown in FIG. 21(C). A cut-out recess may also be provided in the arm of the movable valve of FIGS. 21(B) and (C).

In addition, by providing only the first damper 17, damping force may be applied only to the toilet seat 11; and by providing only the second damper 18, damping force may be provided only to the toilet lid 12. Moreover, a toilet lid 12 need not be provided. When a toilet lid 12 is not provided, three types of configurations may be employed: a structure where a damper is provided only on one of the toilet seat hinges of the toilet seat 11; a structure where dampers are provided on the toilet seat hinges of both sides in a symmetrical configuration; and a structure where the gap between the two toilet seat hinges is narrowed, and one toilet damping device is provided within the gap, with both ends or one end of the support shaft effecting the damping action.

In addition, screw holes through which screws 63 are inserted may also be provided in the protrusions 65. The surface of the cover 54 may be provided with a small circular depression for thickness reduction in order to increase strength and reduce weight. Moreover, the constitution of the oil impingement part 91 of the movable valve 57 is not limited to the embodiment described above. In particular, the slant angle of the pressure-receiving surface 91*a* may be increased or decreased.

Figure 23A:
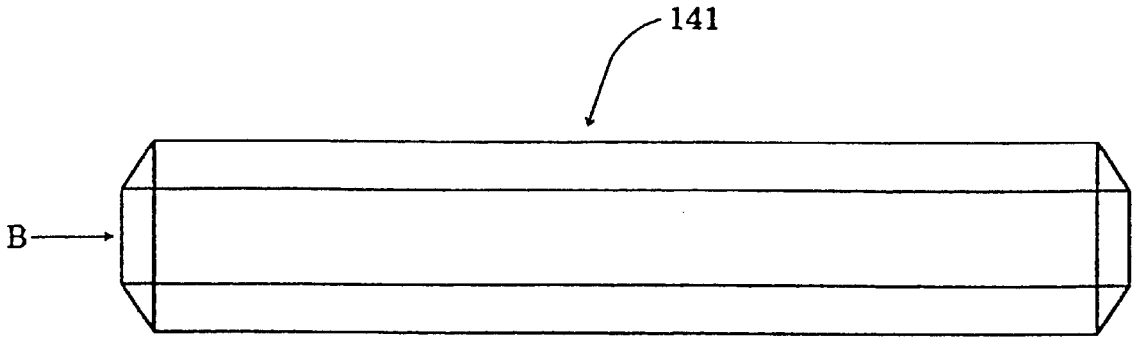
FIGS. 23(A) and (B) show an alternative embodiment of the support shaft used in the toilet seat/toilet lid unit of FIG. 1, where
Figure 23B:
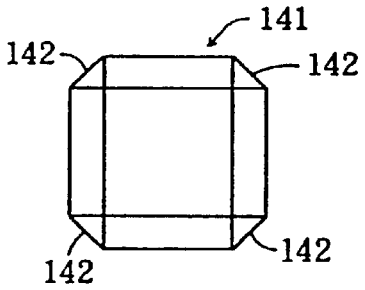
FIG. 23(B) is a side view along the direction of the arrow B in FIG. 23(A).
Figure 24A:
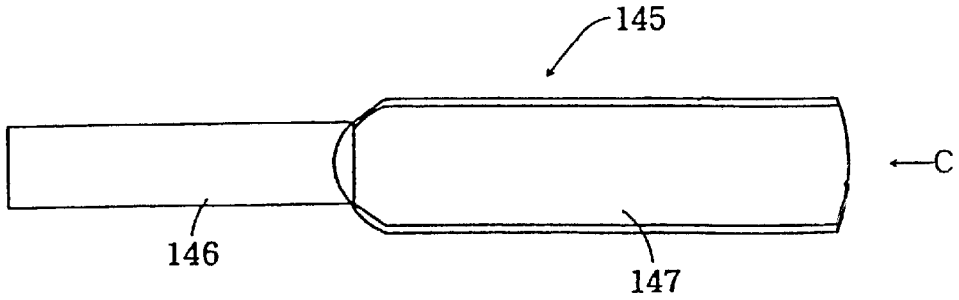
FIGS. 24(A)–(C) show another alternative embodiment of the support shaft used in the toilet seat/toilet lid unit of FIG. 1, where
Figure 24B:
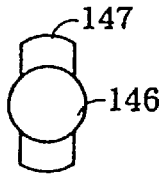
Figure 24C:
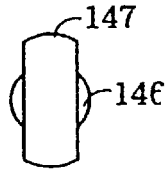

In addition, as shown in FIGS. 23(A) and (B), the support shaft may have a square cross-sectional shape, and a support shaft 141 may be produced where the four comers 142 are highly beveled into curves. Alternately, as shown in FIGS. 24(A)–(C), a support shaft 145 may be produced that includes a round cylinder 146 with a circular cross section, and a flat part 147 with an elliptical cross-section.

When the support shaft 141 is used, the hole 26 of the toilet seat hinge 13, the hole 42 of the toilet lid hinge 16, and the insertion holes 83 of the first and second damping devices 17 and 18 for the toilet may each have the same cross-sectional shape as the support shaft 141, so that the support shaft 141 may be inserted and joined with each of them. On the other hand, the hole 36 of the collar 37 and the hole 29 of the collar 30 may have a circular cross-section so that the toilet seat hinge 14 and the toilet lid hinge 15 may rotate freely with respect to the support shaft 141.

Figure 25A:
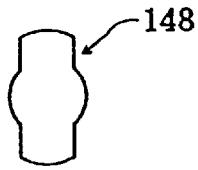
FIGS. 25(A) and (B) show the shape of the insertion holes, openings and holes when the support shaft of FIG. 26 is used, where
Figure 25B:
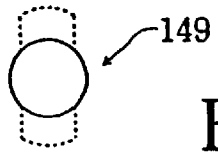
FIG. 25(B) shows the shape of the holes.
Figure 26:
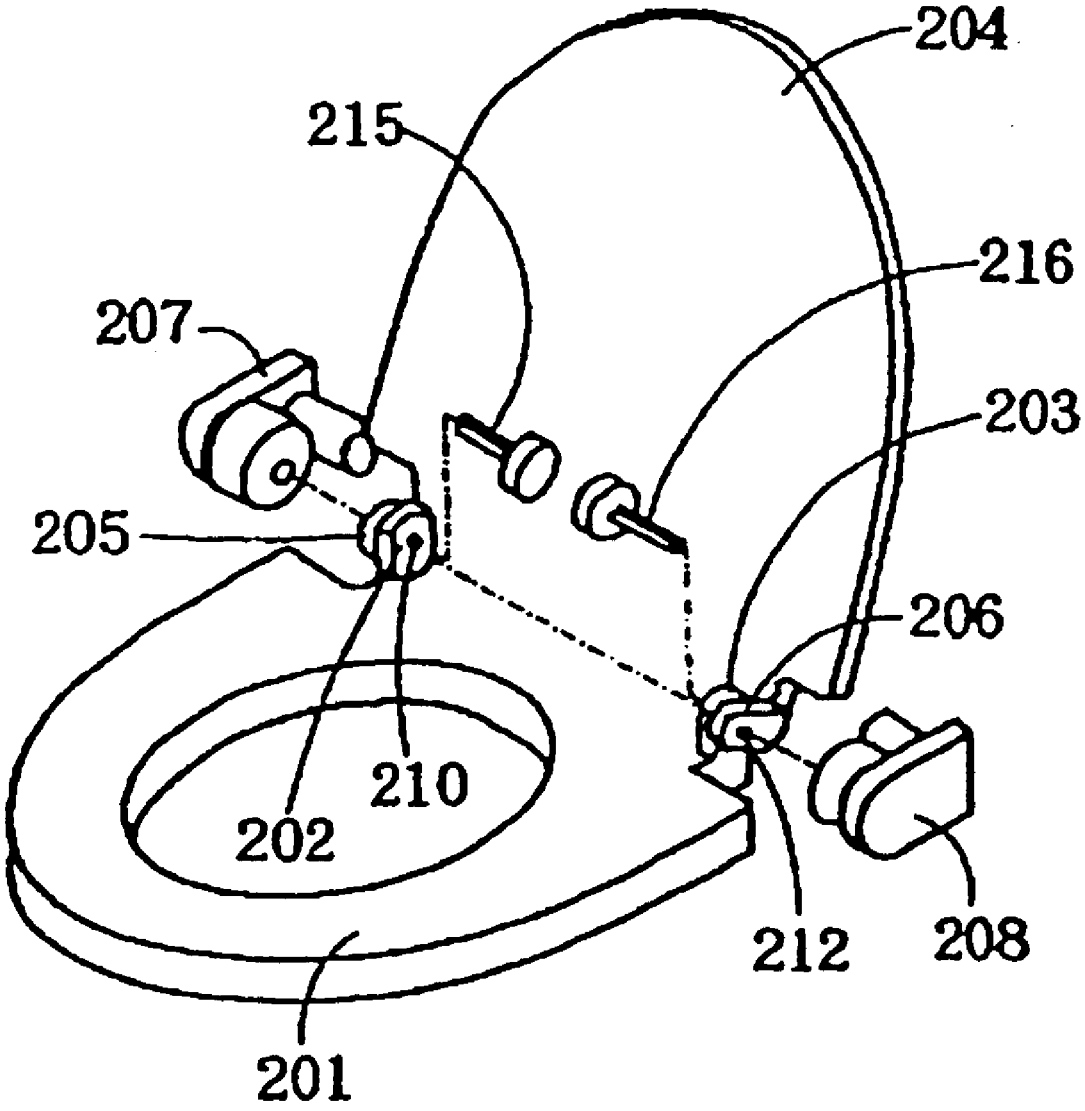
FIG. 26 PRIOR ART
FIG. 26 is an exploded perspective view of a conventional opening/closing device for toilet seats and toilet lids.
Figure 27:
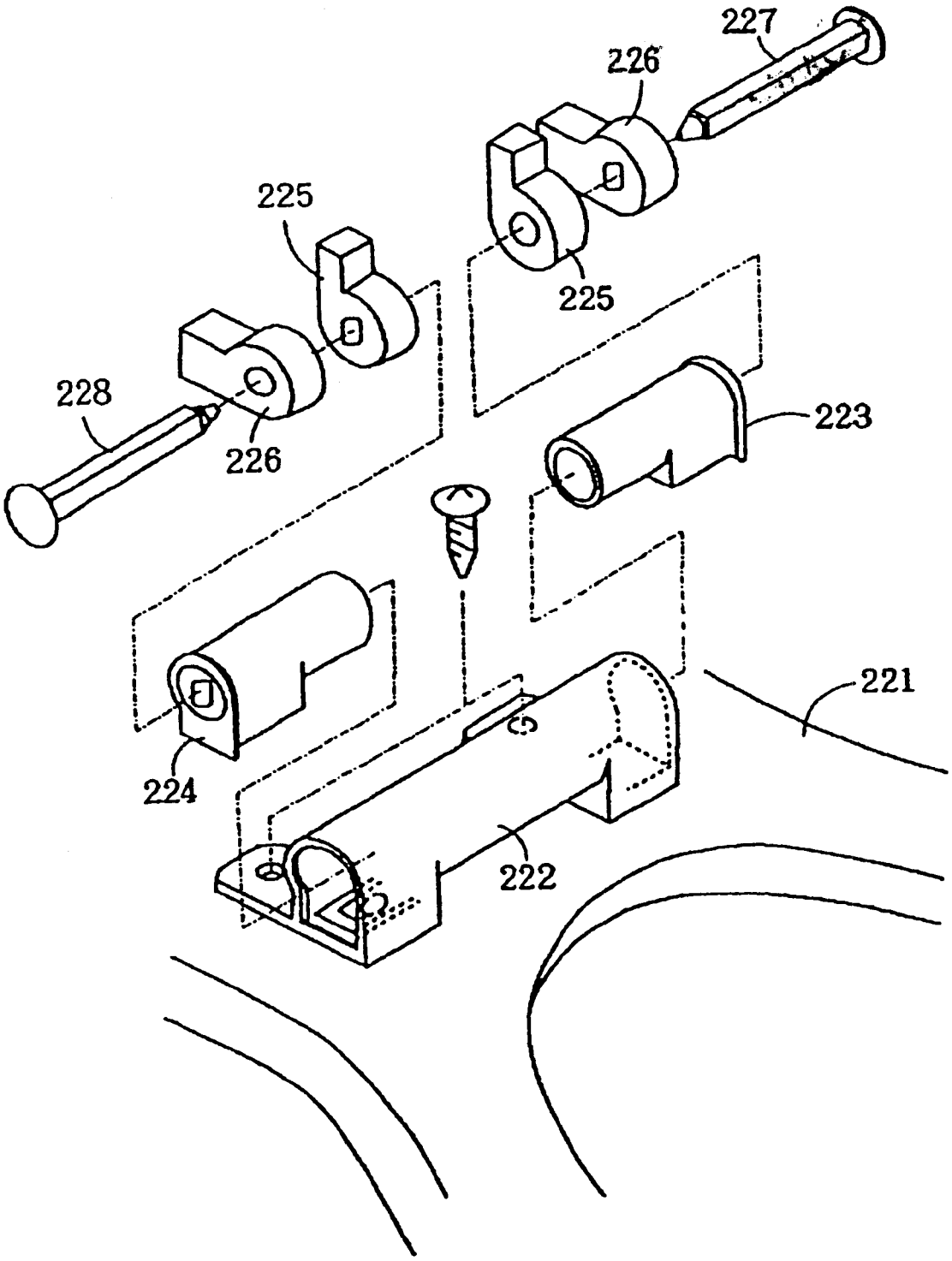
FIG. 27 PRIOR ART
FIG. 27 is an exploded perspective view of another conventional opening/closing device for toilet seats and toilet lids.

When the support shaft 145 is used, the hole 26 of the toilet seat hinge 13, the hole 42 of the toilet lid hinge 16, and the insertion holes 83 of the first and second toilet damping devices 17 and 18 may all have the special hole shape 148 shown in FIG. 25(A) whereby the cylindrical part 146 and the flat part 147 are both inserted. On the other hand, the hole 29 of the collar 30, and the hole 36 of the collar 37 may both have the circular cross-sectional shape 149 shown in FIG. 25B so that the toilet seat hinge 14 and the toilet lid hinge 15 may freely rotate with respect to the cylindrical part 146 of the support shaft 145.

In addition, the above embodiments describe a damping device having two members that rotate relative to each other, where the outer member (the casing) is mounted to the toilet and stationary, while the inner member (the rotor) is linked to the rotating part of the toilet (the seat or the lid). Alternatively, the damping device may be constructed so that the inner member is mounted on the toilet and stationary, while the outer member is linked to the rotating part of the toilet (the seat or the lid).

Moreover, the damping devices 22 and 24 may be used for controlling the movement of other rotating members beside toilet seats and lids, such as for opening and closing lid members on electronic devices or the like.

It will be apparent to those skilled in the art that various modifications and variations may be made in a method of fabricating a thin film transistor of the present invention without departing from the spirit or scope of the inventions. Thus, it is intended that the present invention covers the modifications and variations of this invention provided they come within the scope of the appended claims and equivalents.

What is claimed is:

1. A damping device for damping the relative rotation of two members, comprising:

a casing having an interior surface defining an interior space;

a rotor disposed in the interior space of the casing, the rotor and casing forming an annular chamber therebetween; and a damping mechanism including a viscous liquid disposed in the chamber, the viscous liquid exerting frictional forces to damp the relative rotation between the rotor and the casing in a first rotation direction, the damping force increasing when the rotor and the casing rotate relative to each other from a first relative angular position to a second relative angular position in the first rotation direction; and the rotor has a core disposed in the interior space of the casing, the casing has at least one protrusion protruding inwardly from the interior surface to the interior space, the core of the rotor has a radius that varies angularly such that the core and the protrusion of the casing forms a gap when the rotor and the casing are at the first relative angular position, and the core and the protrusion come into contact when the rotor and casing rotate relatively from the first relative angular position to or near the second relative angular position, whereby the contact generates a damping force that impedes the relative rotation of the rotor and the casing in the first rotation direction;

wherein the interior space defined by the casing has a radius that decreases with an angular position within an angular range, as defined by a small hole diameter region, a connecting region and a large hole diameter region extending around the interior space.

2. A damping device for damping the relative rotation of two members, comprising:

a casing having an interior surface defining an interior space;

a rotor disposed in the interior space of the casing, the rotor and casing arming an annular chamber therebetween; and a damping mechanism including a viscous liquid disposed in the chamber, the viscous liquid exerting frictional forces to damp the relative rotation between the rotor and the casing in a first rotation direction, the damping force increasing when the rotor and the casing rotate relative to each other from a first relative angular position to a second relative angular position in the first rotation direction; and the rotor has a core disposed in the interior space of the casing, the casing has at least one protrusion protruding inwardly from the interior surface to the interior space, the core of the rotor has a radius that varies angularly such that the core and the protrusion of the casing forms a gap when the rotor and the casing are at the first relative angular position, and the core and the protrusion come into contact when the rotor and casing rotate relatively from the first relative angular position to or near the second relative angular position, whereby the contact generates a damping force that impedes the relative rotation of the rotor and the casing in the first rotation direction;

wherein the rotor has at least one protrusion protruding outwardly from the core and having a retaining part, wherein the device further comprises at least one movable valve disposed within the annular chamber between the casing and the core of the rotor and controlling the flow of the viscous liquid within the chamber, the valve being latched to the retaining part of the protrusion of the rotor and moves with the rotor, a latching position of the movable valve changing with the direction of rotation of the rotor.

3. The device of claim 2, wherein the movable valve has a pressure-receiving surface disposed to receive a pressure of the viscous liquid when the rotor rotates in the first direction, the pressure-receiving surface forming an angle with respect to a tangential direction of the rotation.

4. A damping device for damping the relative rotation of two members, comprising:

a casing having an interior surface defining an interior space;

a rotor disposed in the interior space of the casing, the rotor and casing forming an annular chamber therebetween; and a damping mechanism including a viscous liquid disposed in the chamber, the viscous liquid exerting frictional forces to damp the relative rotation between the rotor and the casing in a first rotation direction, the damping force increasing when the rotor and the casing rotate relative to each other from a first relative angular position to a second relative angular position in the first rotation direction; and the rotor has a core disposed in the interior space of the casing, the casing has at least one protrusion protruding inwardly from the interior surface to the interior space, the core of the rotor has a radius that varies angularly such that the core and the protrusion of the casing forms a gap when the rotor and the casing are at the first relative angular position, and the core and the protrusion come into contact when the rotor and casing rotate relatively from the first relative angular position to or near the second relative angular position, whereby the contact generates a damping force that impedes the relative rotation of the rotor and the casing in the first rotation direction;

a toilet bowl comprising a toilet seat or a toilet lid, wherein the casing of the damping device is mounted on the toilet bowl and the rotor of the damping device is attached to the toilet seat or toilet lid to rotate therewith as a unit, and wherein the rotor of the damping device rotate in the first rotation direction when the toilet seat or toilet lid rotates in the downward direction.

5. A toilet seat and toilet lid unit for a toilet bowl having a rotating member, comprising a toilet seat having first and second toilet seat hinges;

a toilet lid having first and second toilet lid hinges; and two damping devices for the toilet seat and the toilet lid respectively, each comprising:

a stationary member;

a rotor disposed to rotate with respect to the stationary member, the rotor defining a through insertion hole;

a support shaft inserted in the insertion hole of the rotor and extending out from at least one end of the insertion hole, the support shaft pivotally supporting the rotating member, and the support shaft rotationally linking the rotor and the rotating member so that they rotate as a unit, wherein the through insertion hole opens at both ends and allows the support shaft to extend out from both ends of the insertion hole; and a damping mechanism for damping the rotation of the rotor relative to the stationary member in a direction corresponding to a downward rotation direction of the rotating member; wherein an end of the support shaft of the first damping device that extends from the insertion hole of the first damping device is linked with the first toilet seat hinge so that the rotor of the first damping device rotates as a unit with the toilet seat, and another end of the first support shaft is linked with the first toilet lid hinge so that the toilet lid rotates freely around the first support shaft;

an end of a second support shaft extends from the insertion hole of the second damping device is linked to the second toilet lid hinge so that the rotor of the second damping device rotates as a unit with the toilet lid, and another end of the second support shaft is linked with the second toilet seat hinge so that the toilet seat rotates freely around the second support shaft;

one of the two damping devices is provided between the first toilet seat hinge and the first toilet lid hinge;

the other of the two damping devices is provided between the second toilet seat hinge and the second toilet lid hinge;

said support shaft extending out from both ends of the insertion hole.

6. The damping device of claim 5, wherein the stationary member comprises a fastening flange for fastening the stationary member to the toilet bowl.

7. The damping device of claim 5, further comprising an attachment casing for attaching the stationary member to the toilet bowl.

8. The damping device of claim 5, wherein a cross section of the support shaft has a substantially square shape with rounded corners.

* * * * *